US010091577B2

(12) United States Patent
Park et al.

(10) Patent No.: US 10,091,577 B2
(45) Date of Patent: Oct. 2, 2018

(54) AUDIO DEVICE

(71) Applicant: SAMSUNG ELECTRONICS CO., LTD., Suwon-si (KR)

(72) Inventors: Min Kyu Park, Hwaseong-si (KR); Kyung Su Kang, Suwon-si (KR); Se Ki Jang, Hwaseong-si (KR); Woo Sung In, Hwaseong-si (KR); Ji Hee Kim, Seoul (KR); Jeong Hoon Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/507,898

(22) PCT Filed: Jul. 6, 2015

(86) PCT No.: PCT/KR2015/006960
§ 371 (c)(1),
(2) Date: Mar. 1, 2017

(87) PCT Pub. No.: WO2016/035990
PCT Pub. Date: Mar. 10, 2016

(65) Prior Publication Data

US 2017/0295426 A1 Oct. 12, 2017

(30) Foreign Application Priority Data

Sep. 1, 2014 (KR) ..... 10-2014-0115736

(51) Int. Cl.
*H04R 1/34* (2006.01)
*H04R 3/12* (2006.01)
(Continued)

(52) U.S. Cl.
CPC ..... *H04R 1/345* (2013.01); *H04R 1/025* (2013.01); *H04R 1/403* (2013.01); *H04R 3/12* (2013.01);
(Continued)

(58) Field of Classification Search
CPC ..... H04R 1/345; H04R 1/025; H04R 1/403; H04R 3/12; H04R 2201/028; H04R 2201/403; H04R 5/02; H04R 2201/025
(Continued)

(56) References Cited

U.S. PATENT DOCUMENTS 4,450,495 A * 5/1984 Naruki ..... G11B 25/063 224/674
8,520,883 B2 * 8/2013 Tracy ..... H04R 1/02 381/182
(Continued)

FOREIGN PATENT DOCUMENTS

JP 9-303032 A 11/1997

OTHER PUBLICATIONS

International Search Report (PCT/ISA/210), issued by International Searching Authority in International Application No. PCT/KR2015/006960, dated Oct. 29, 2015.
(Continued)

*Primary Examiner* — Jason R Kurr
(74) *Attorney, Agent, or Firm* — Sughrue Mion, PLLC

(57) ABSTRACT

An audio device having an improved bendable structure is disclosed. The audio device includes an amplifier unit configured to amplify an audio signal, at least one speaker unit configured to output the amplified audio signal as a sound signal, and at least one link unit rotatably connecting the at least one speaker unit to the amplifier unit.

20 Claims, 21 Drawing Sheets

(51) Int. Cl.
*H04R 5/02* (2006.01)
*H04R 1/02* (2006.01)
*H04R 1/40* (2006.01)

(52) U.S. Cl.
CPC ..... *H04R 5/02* (2013.01); *H04R 2201/025* (2013.01); *H04R 2201/028* (2013.01); *H04R 2201/403* (2013.01)

(58) Field of Classification Search
USPC ..... 381/334, 335
See application file for complete search history.

(56) References Cited

U.S. PATENT DOCUMENTS

2007/0014426 A1* 1/2007 Sung ..... G03B 31/00 381/386
2008/0123894 A1* 5/2008 Lu ..... H04R 1/403 381/394
2009/0080684 A1 3/2009 Groset et al.
2010/0202647 A1* 8/2010 Kuan ..... G06F 1/1688 381/334
2011/0235846 A1 9/2011 Jiang et al.
2012/0042484 A1 2/2012 Hsu Huang et al.
2012/0308065 A1 12/2012 Padalino et al.
2014/0023220 A1* 1/2014 Ku ..... H04R 1/403 381/333
2015/0036858 A1* 2/2015 Aboabdo ..... H04R 1/02 381/334
2015/0086035 A1* 3/2015 Shin ..... H04R 1/02 381/86
2015/0131842 A1* 5/2015 Watanabe ..... H04R 1/025 381/387
2015/0343961 A1* 12/2015 Yu ..... B60R 11/0217 381/389

OTHER PUBLICATIONS

Written Opinion (PCT/ISA/237), issued by International Searching Authority in International Application No. PCT/KR2015/006960, dated Oct. 29, 2015.

* cited by examiner

[Fig. 1]
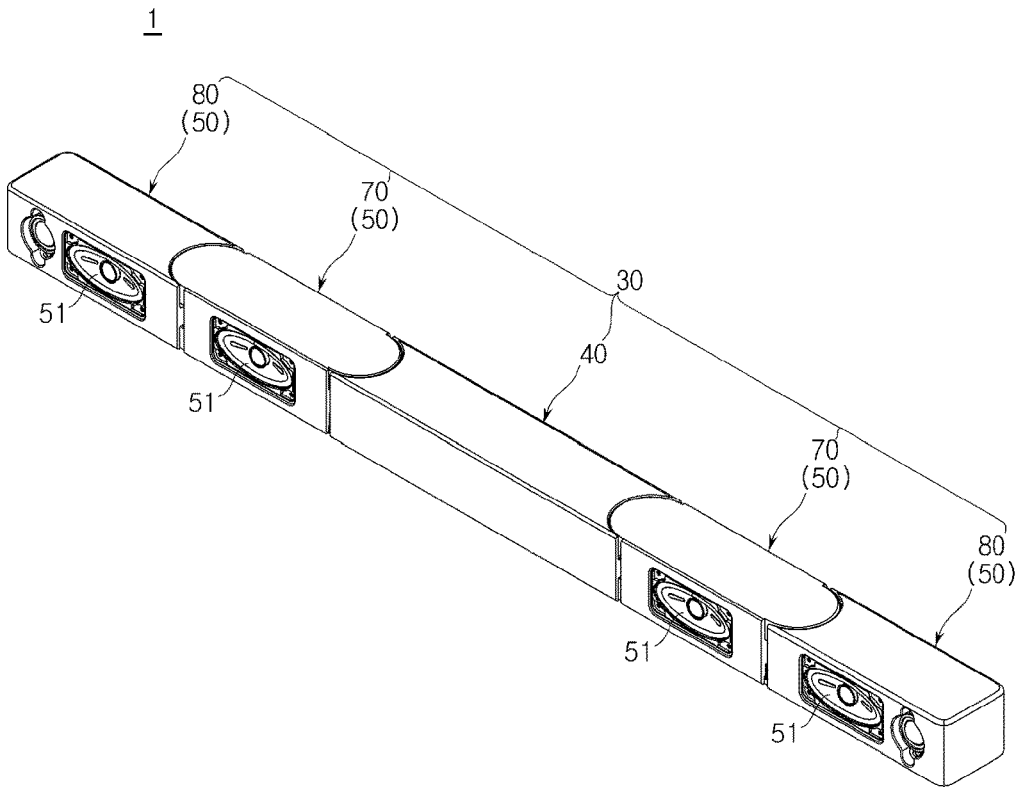
[Fig. 2]
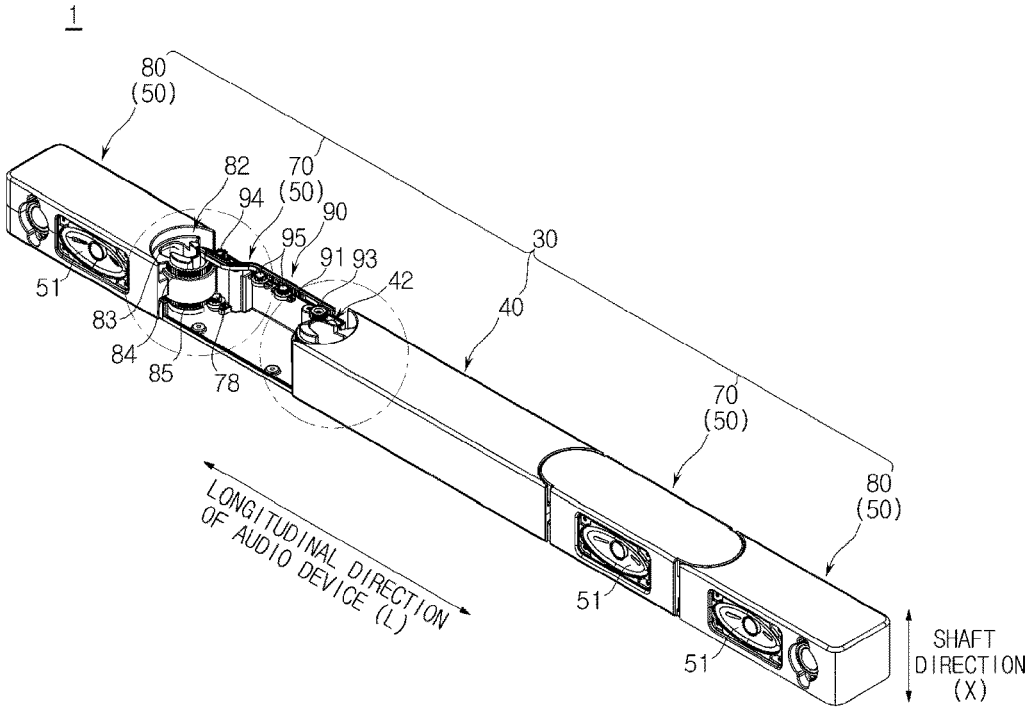

[Fig. 3a]
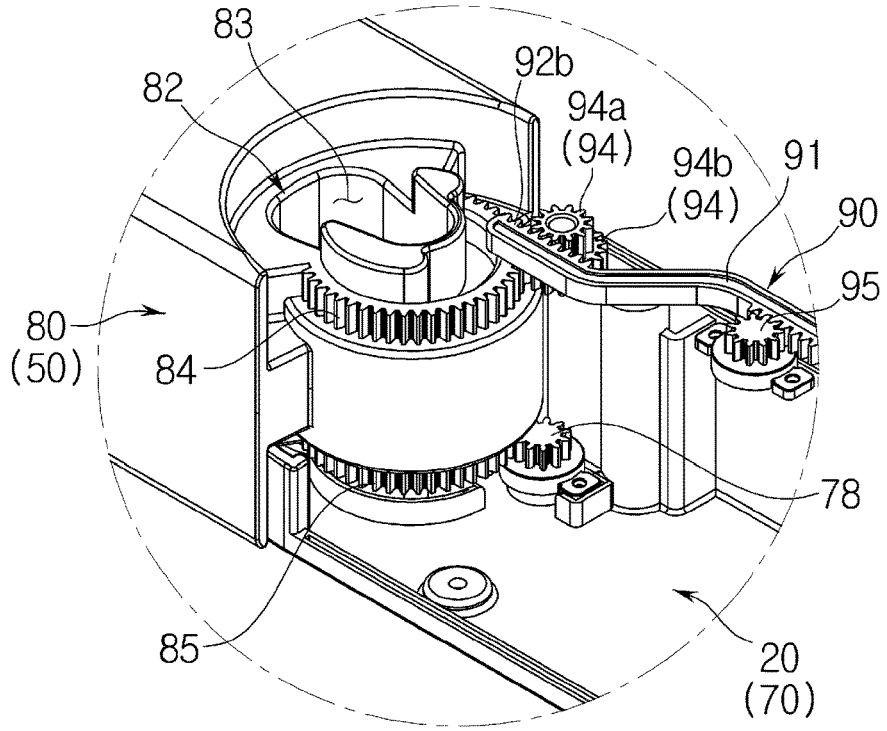
[Fig. 3b]
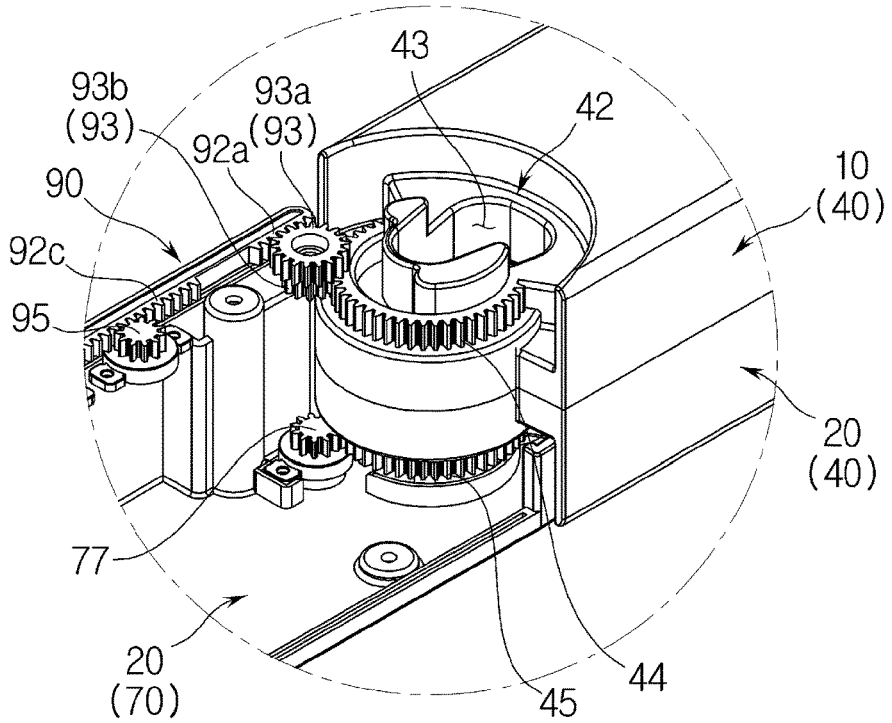

[Fig. 4a]
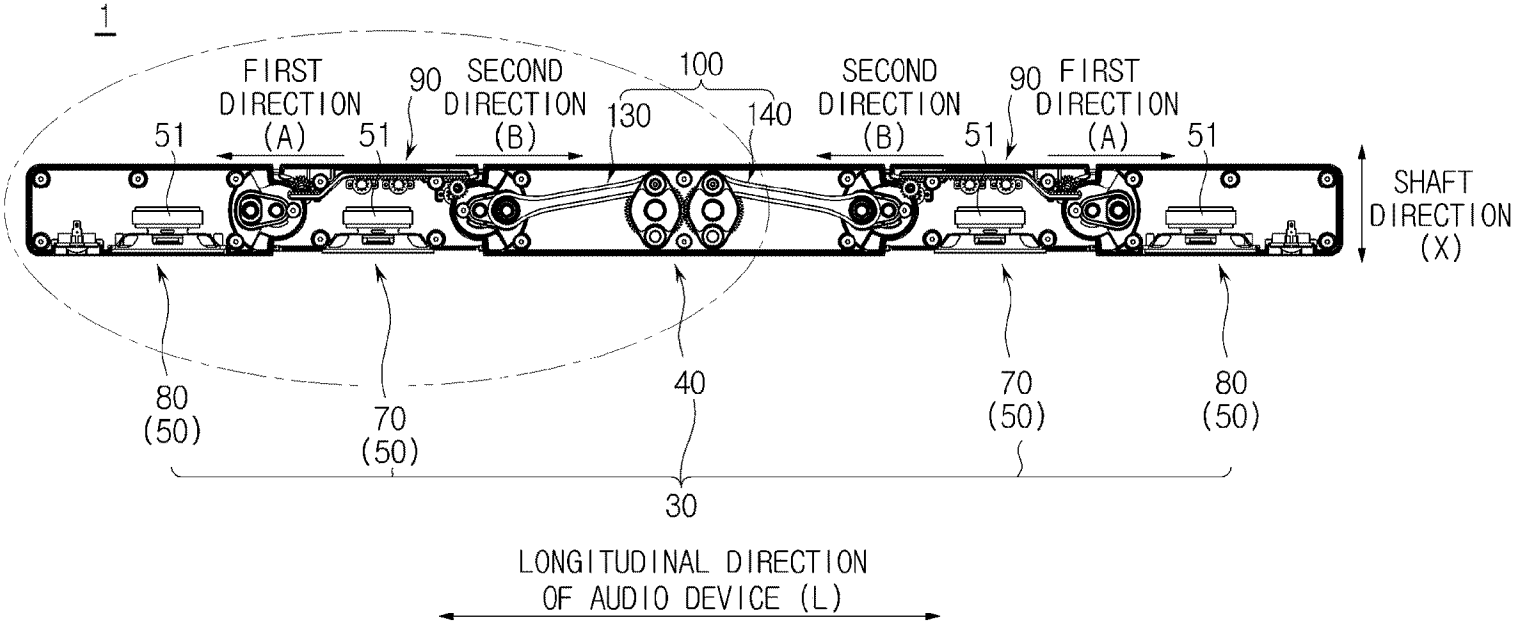

[Fig. 4b]
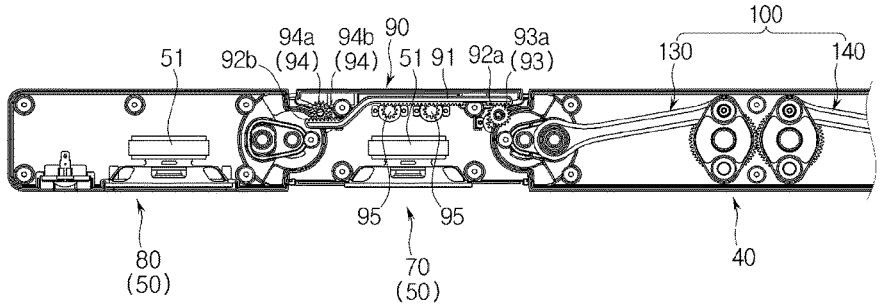
[Fig. 5a]
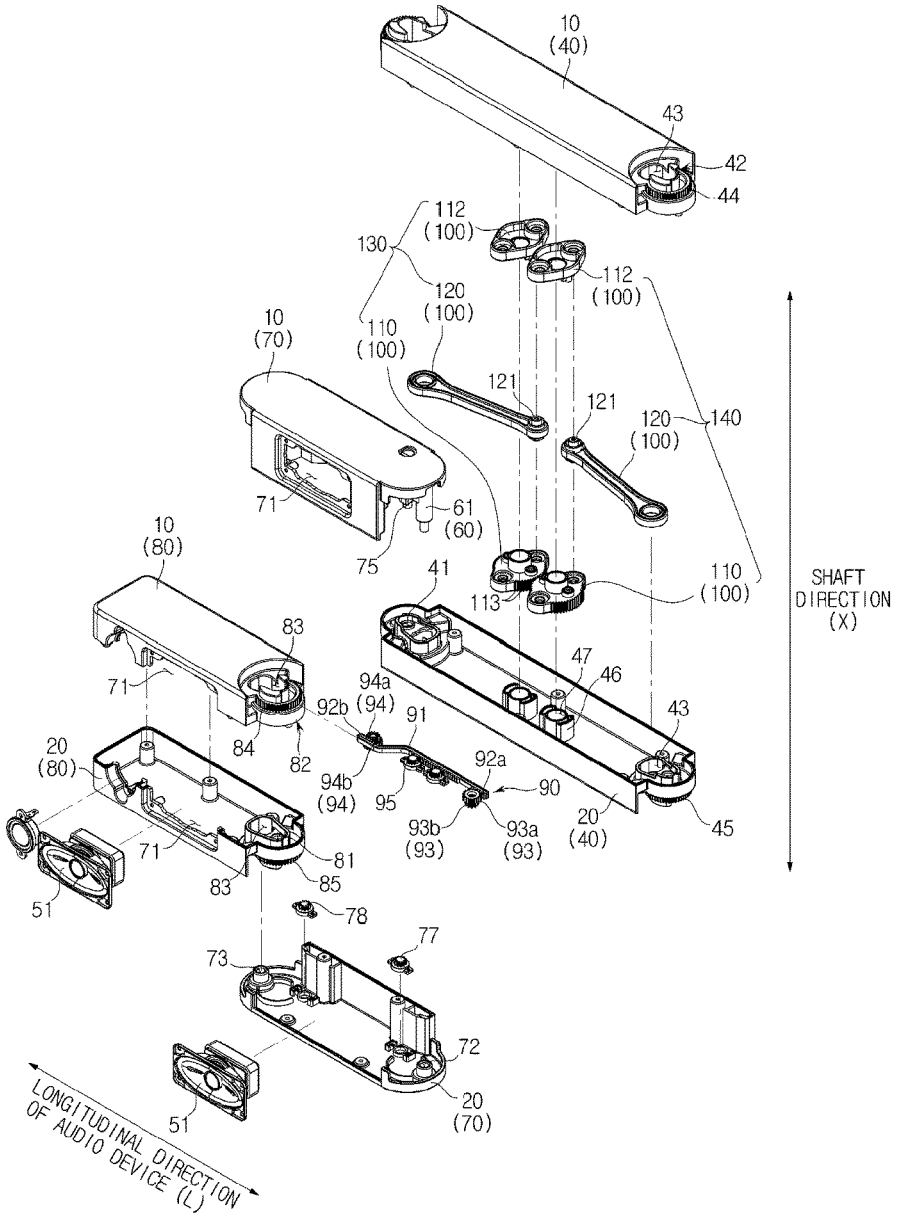

[Fig. 5b]
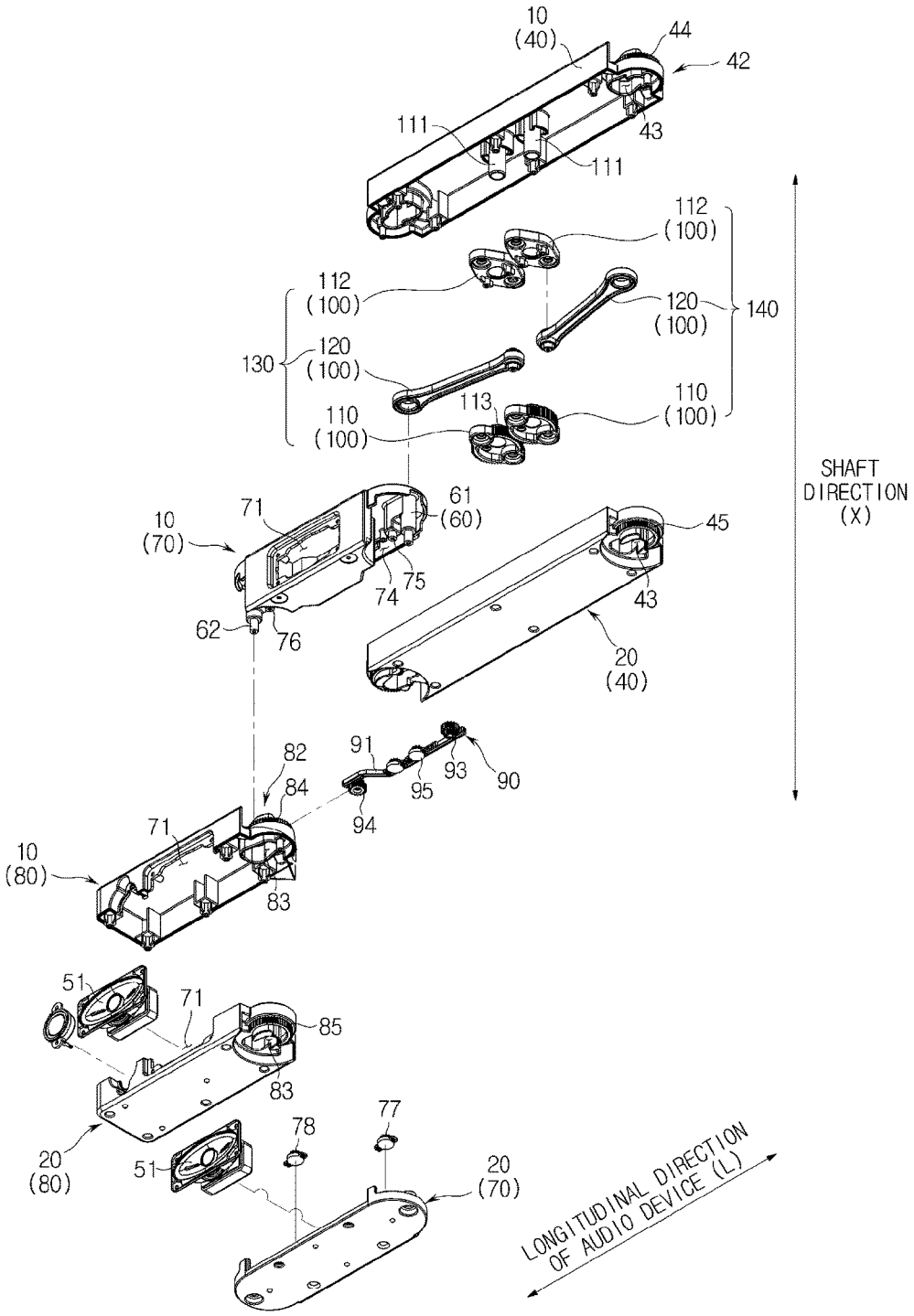

[Fig. 6]
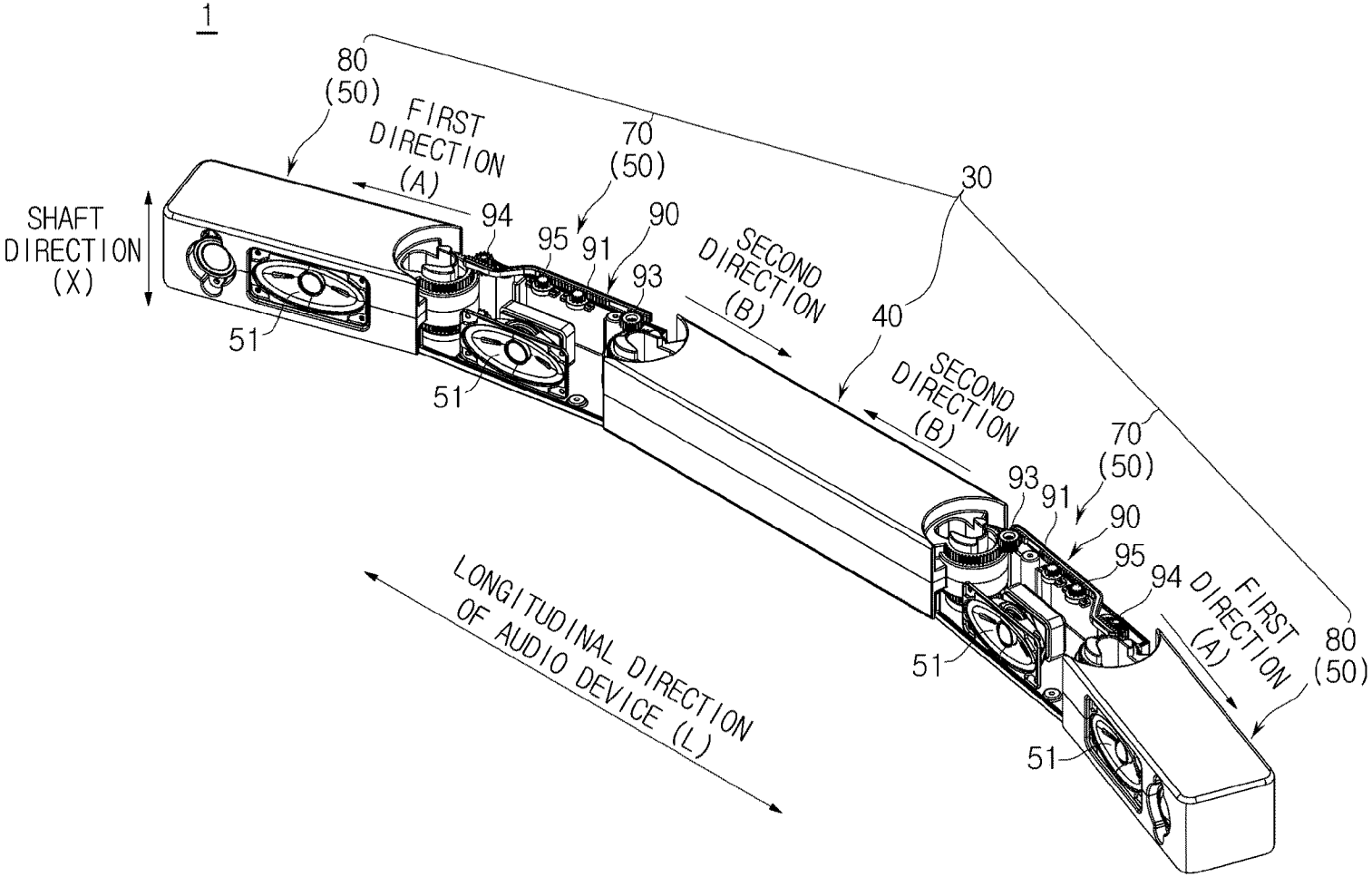

[Fig. 7]
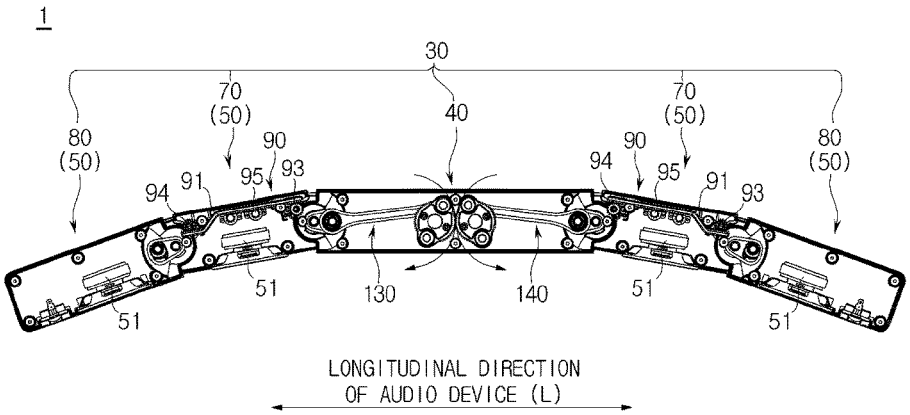
[Fig. 8]
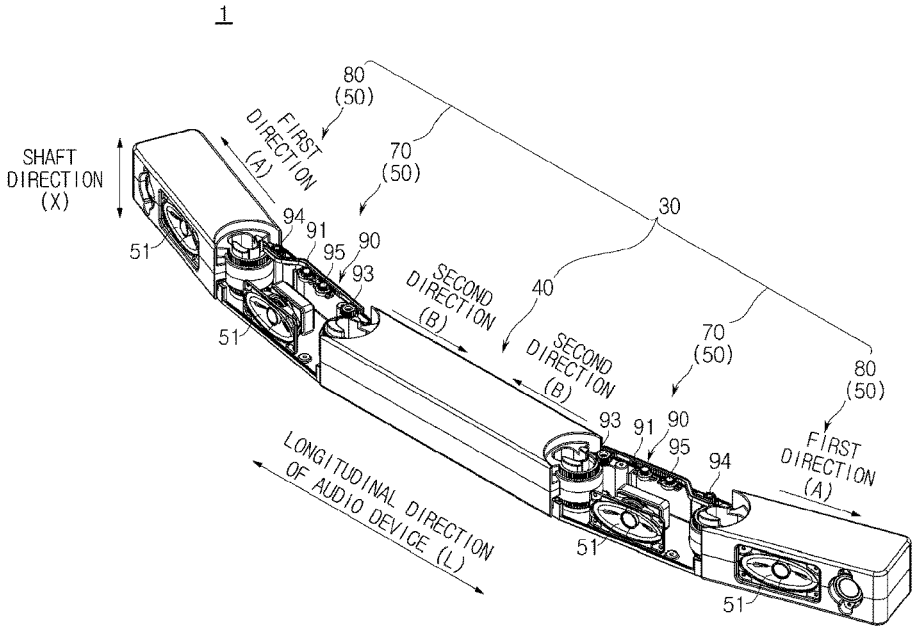
[Fig. 9]
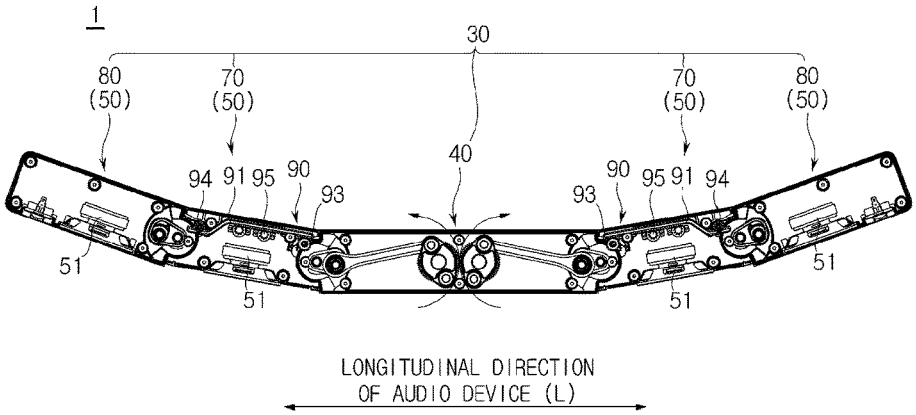

[Fig. 10]
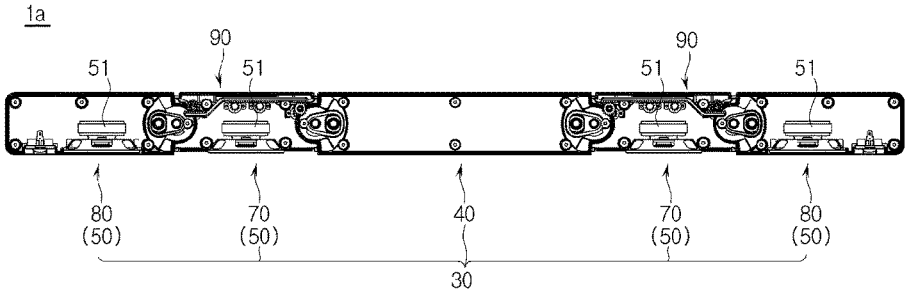
[Fig. 11a]
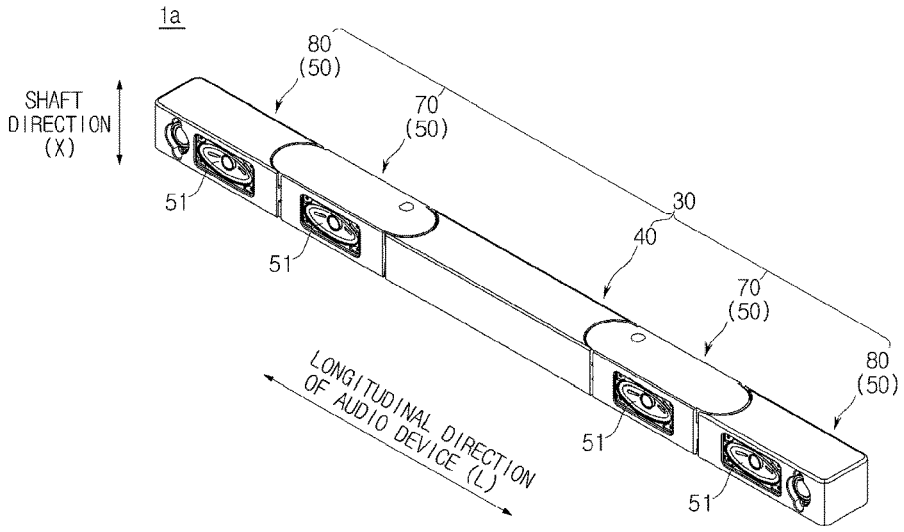
[Fig. 11b]
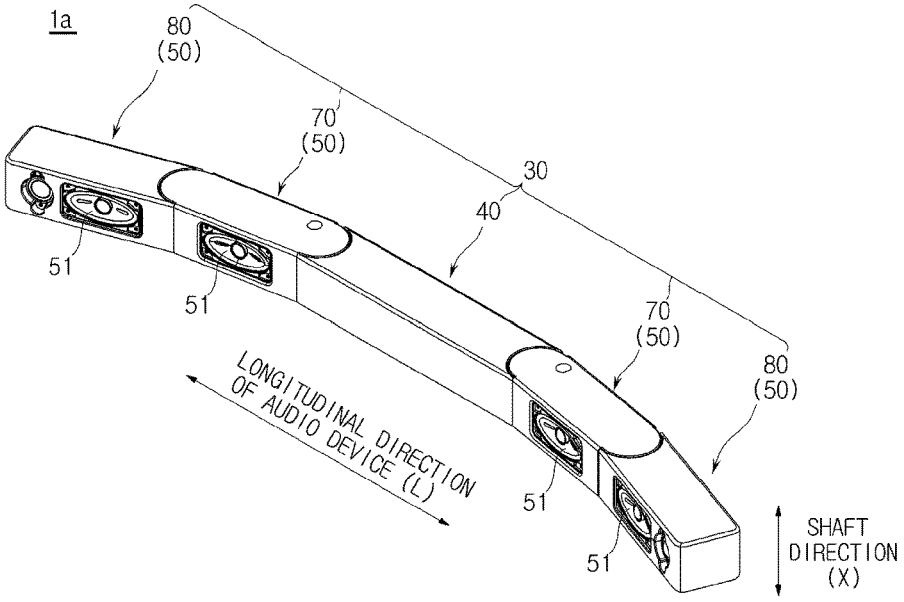

[Fig. 11c]
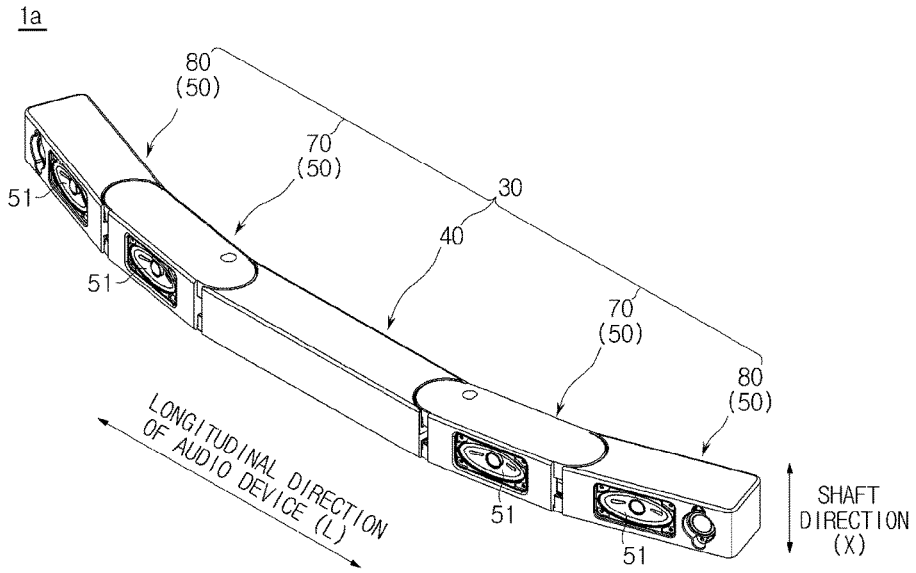
[Fig. 11d]
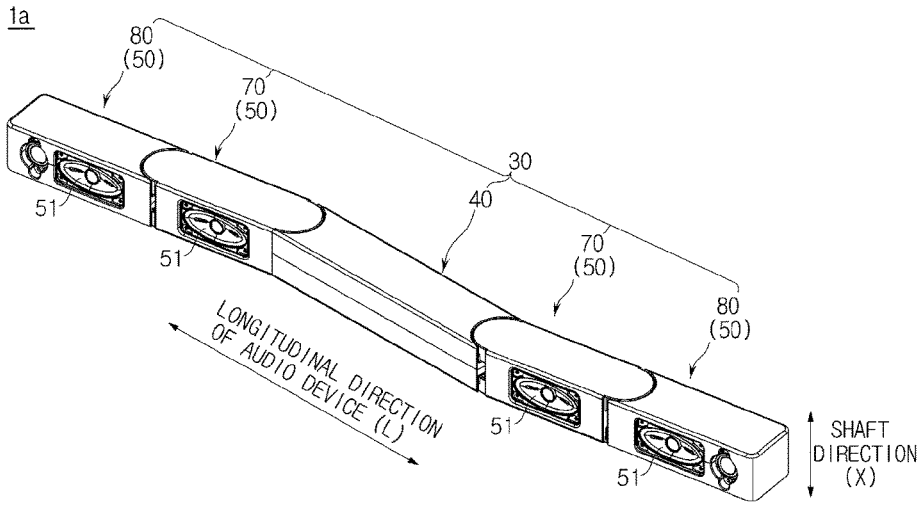

[Fig. 12]
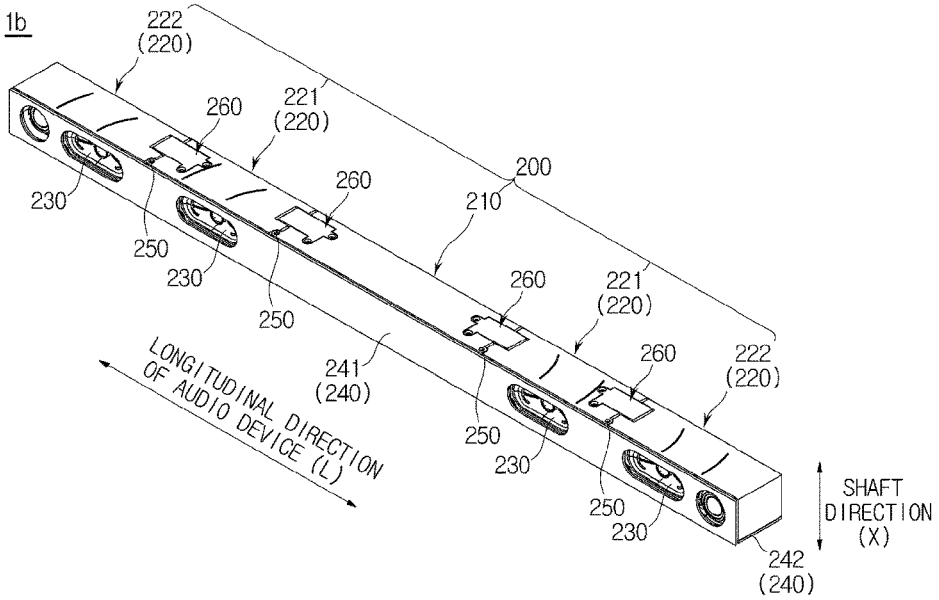
[Fig. 13]
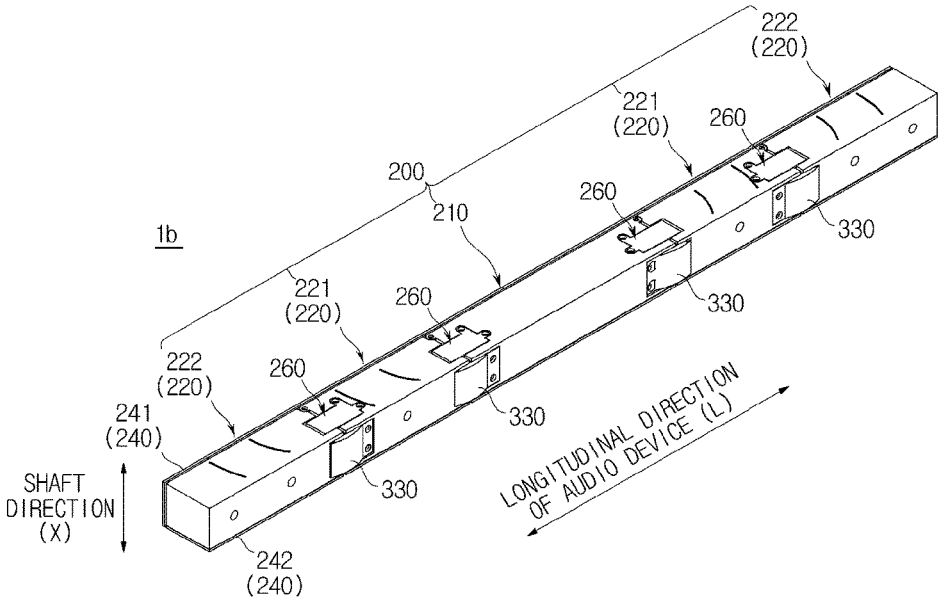

[Fig. 14]
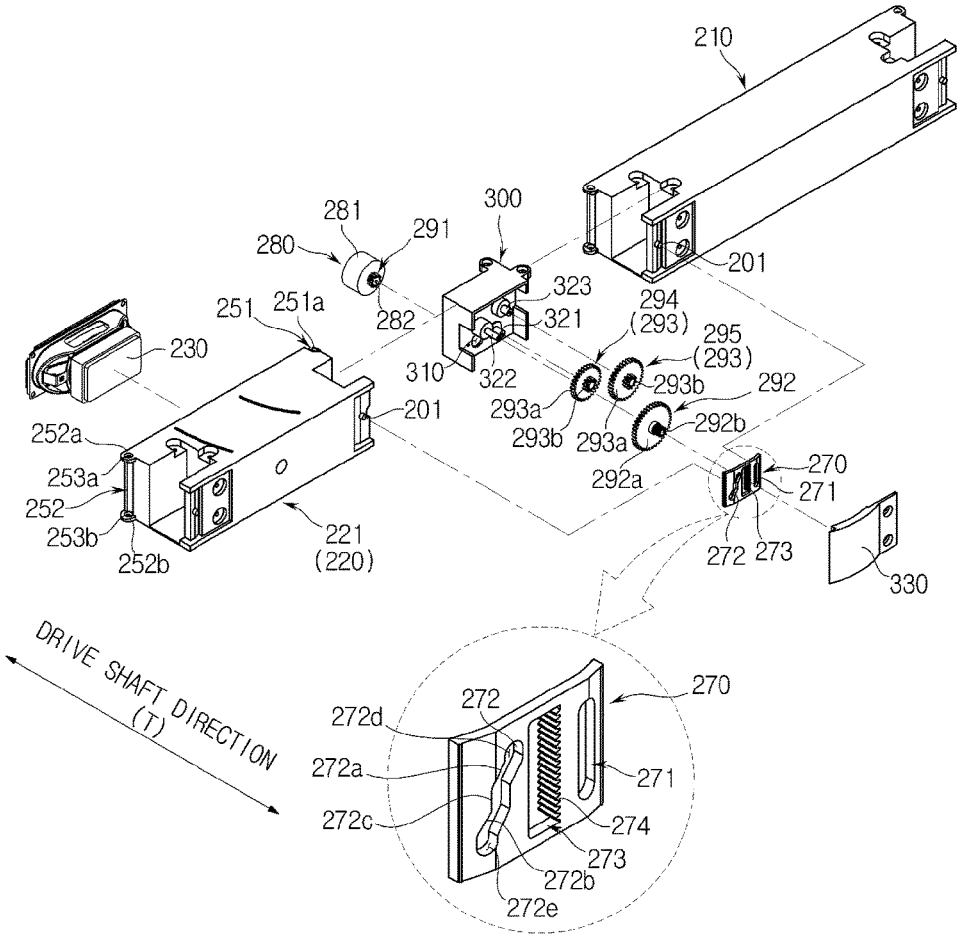
290:291,294,295,292

[Fig. 15]
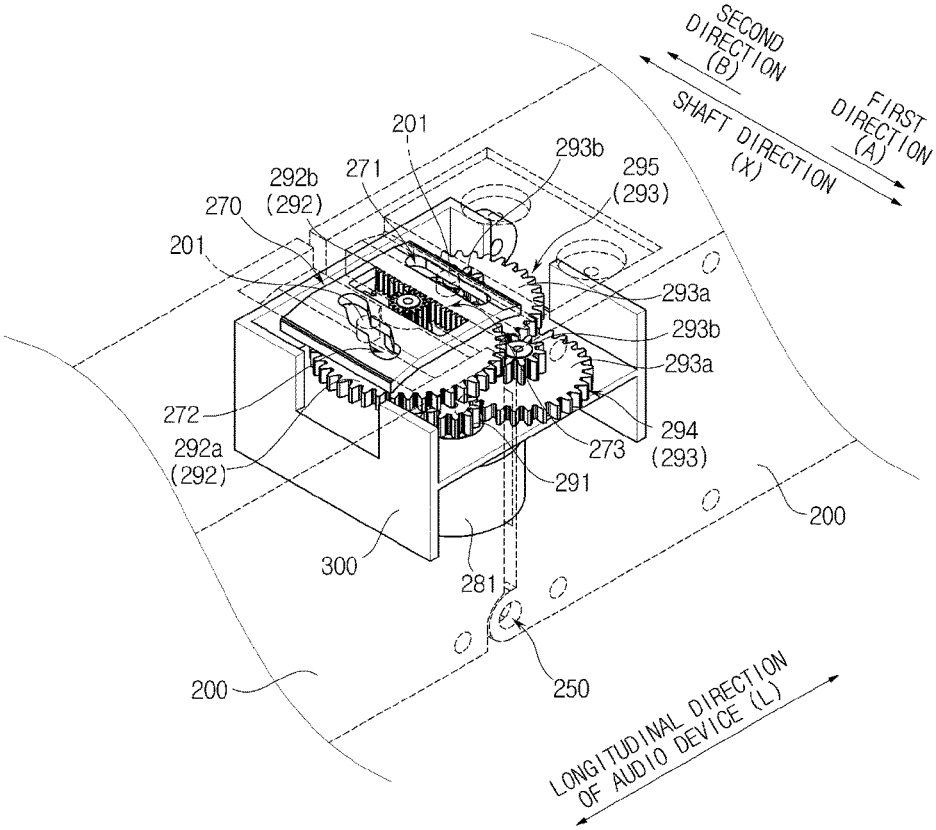

[Fig. 16]
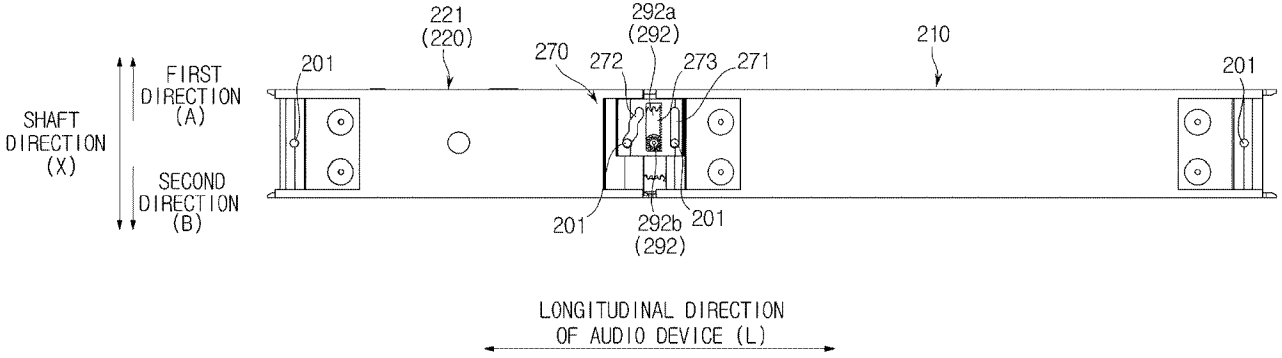
[Fig. 17]
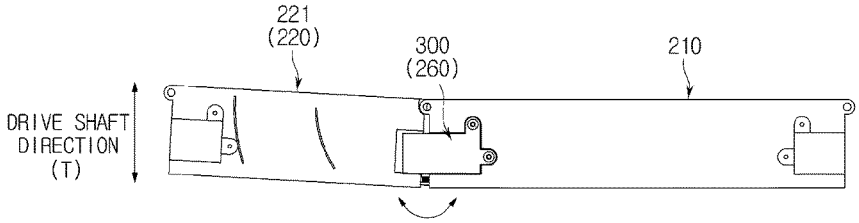

[Fig. 18]
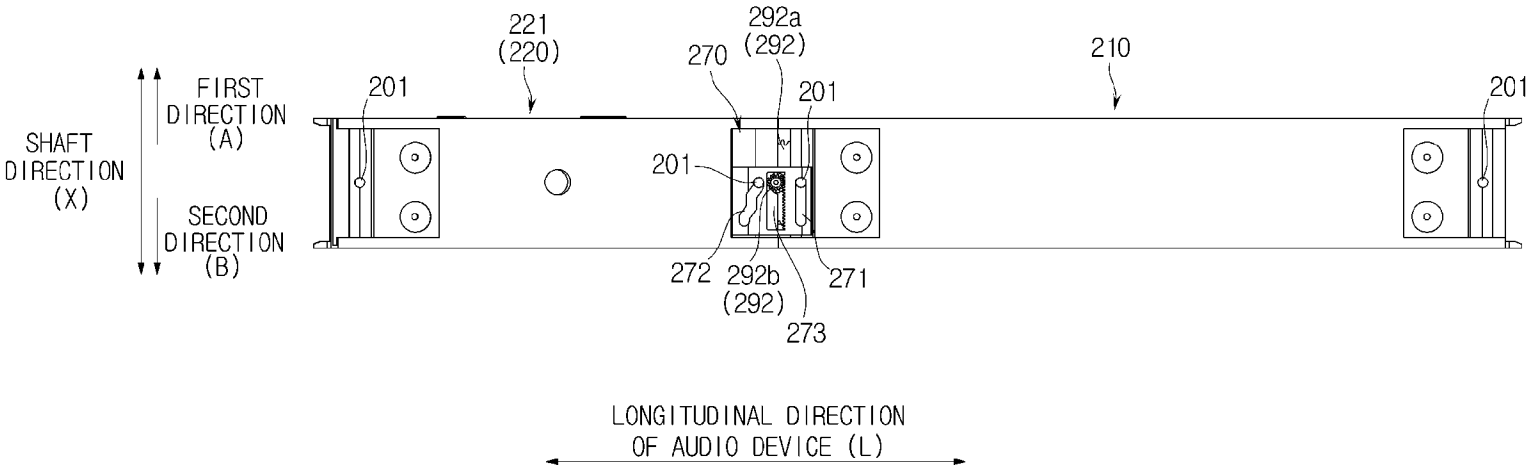

[Fig. 19]
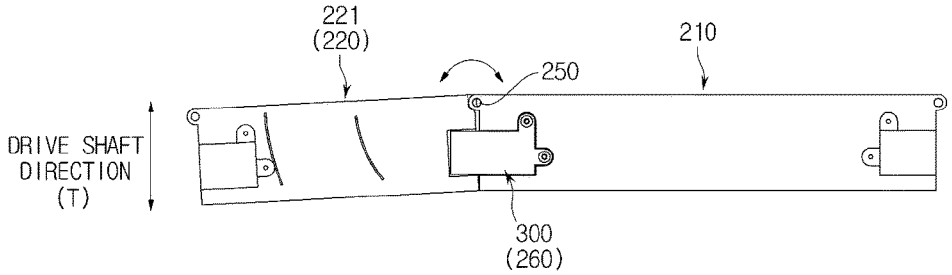
[Fig. 20a]
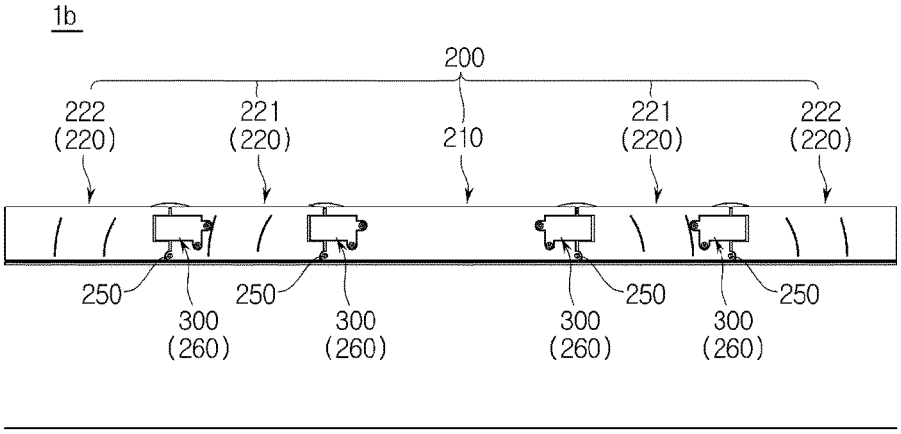
[Fig. 20b]
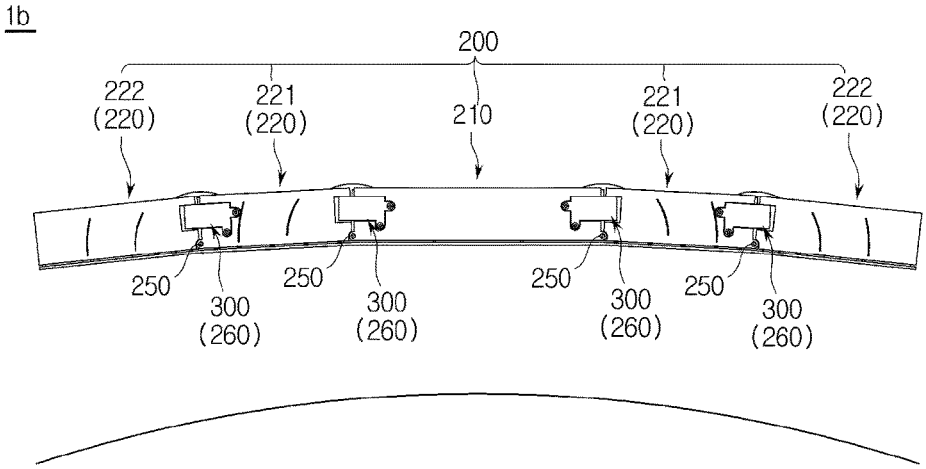

[Fig. 20c]
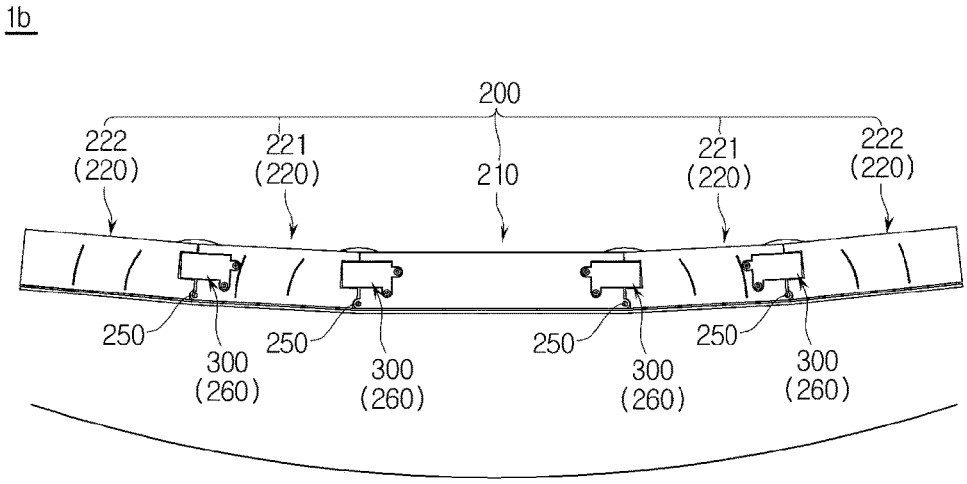
[Fig. 20d]
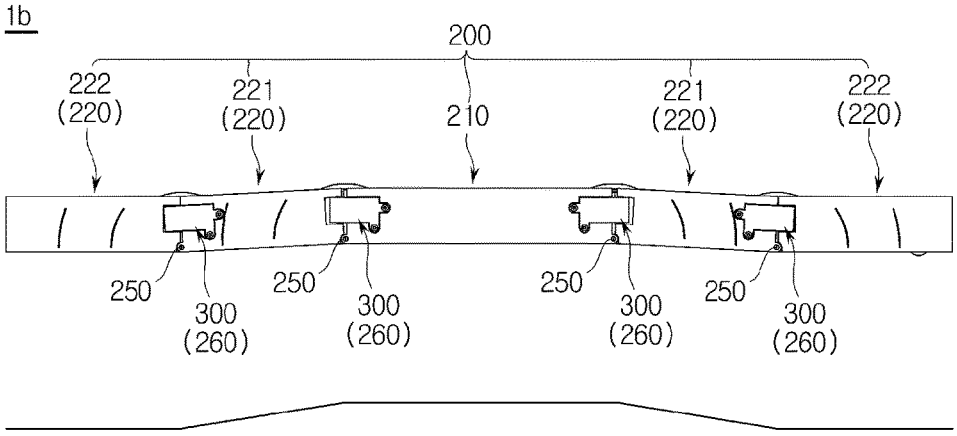

[Fig. 21]
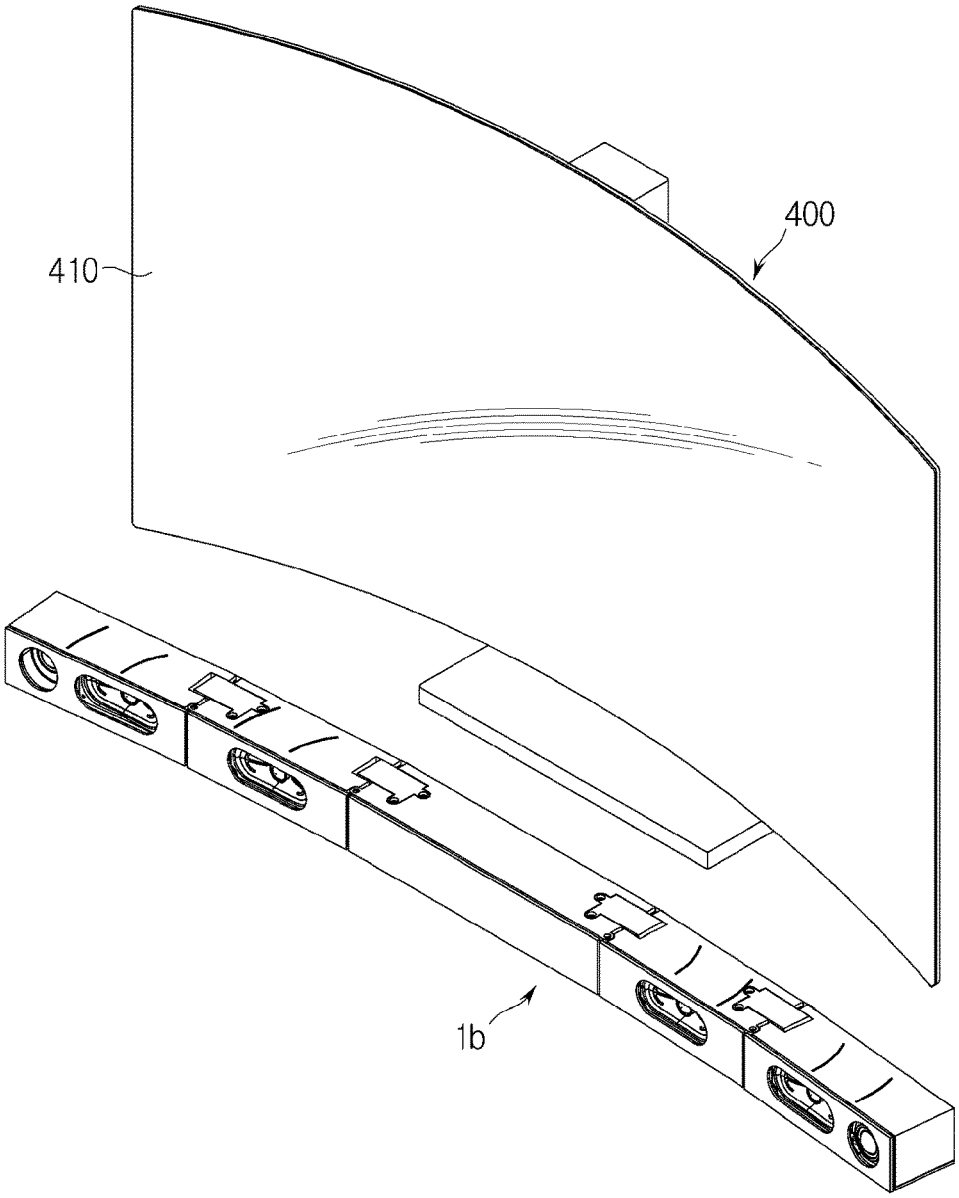

[Fig. 22]
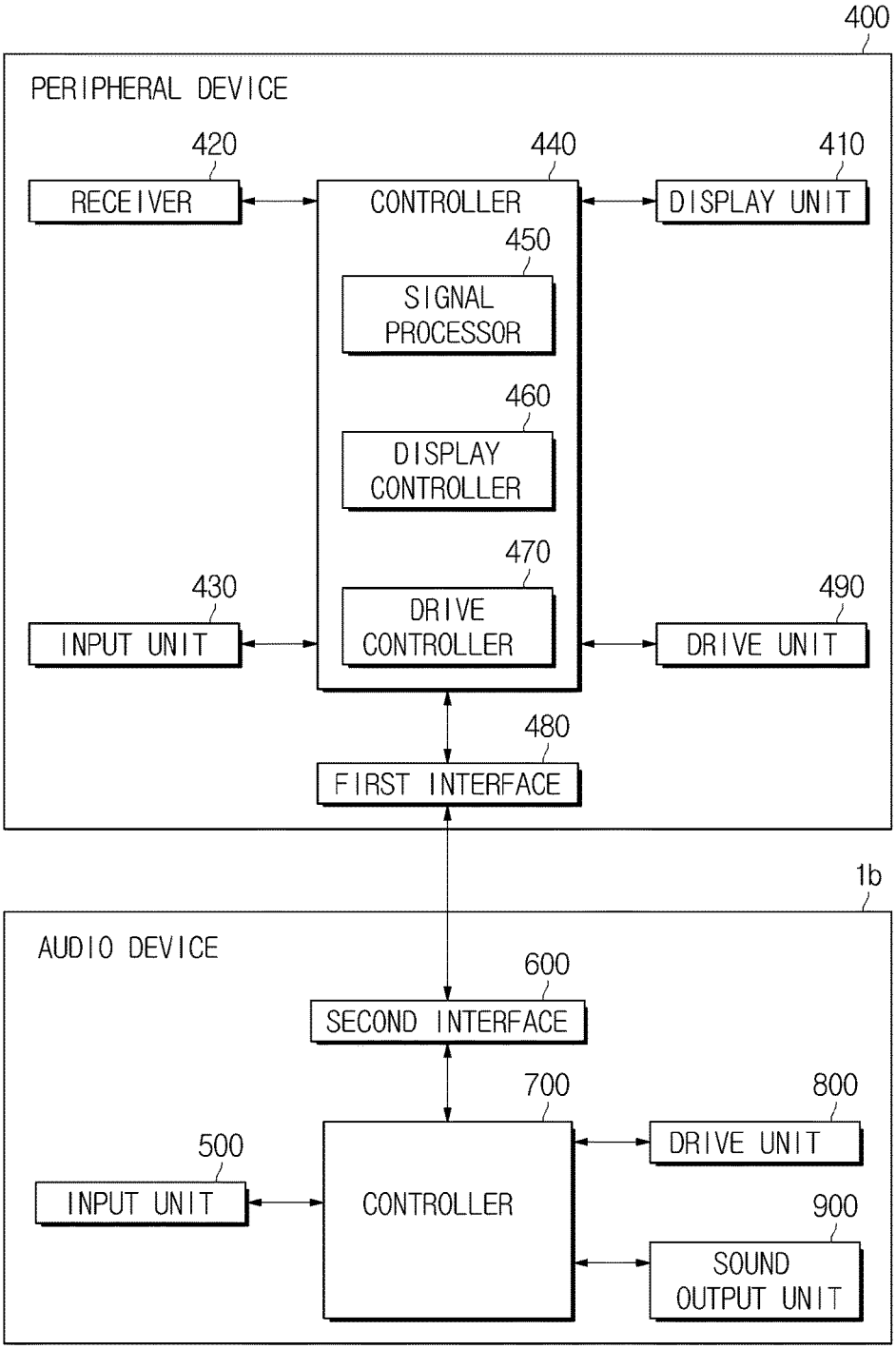

[Fig. 23]
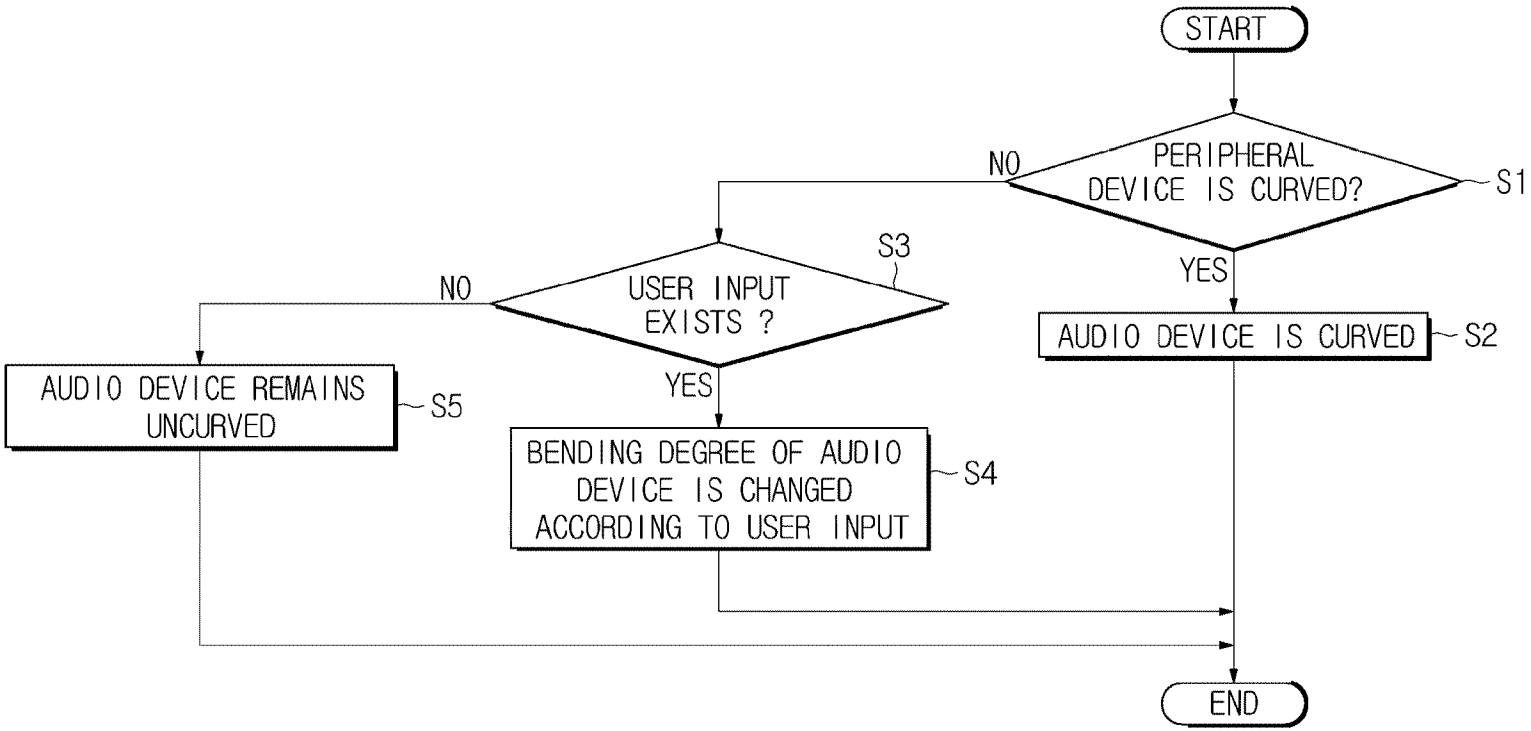

[Fig. 24]
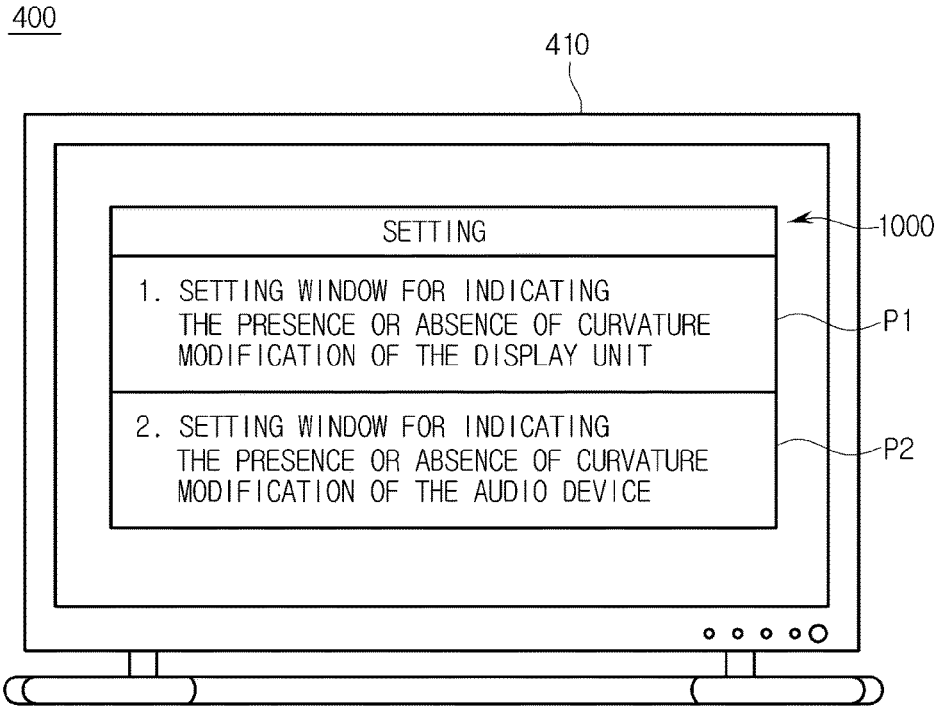
[Fig. 25a]
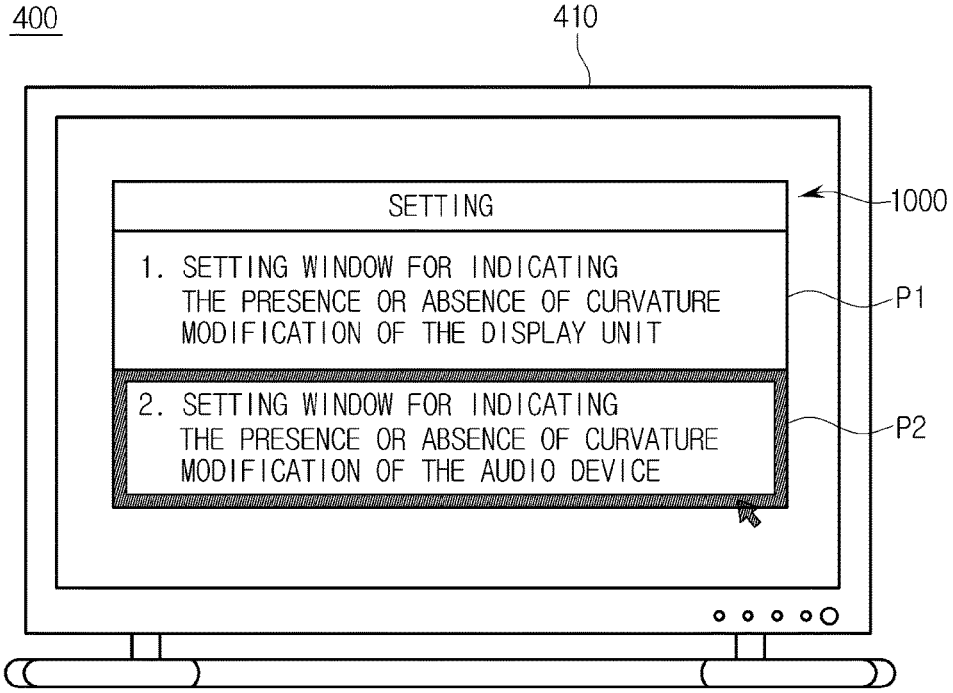

[Fig. 25b]
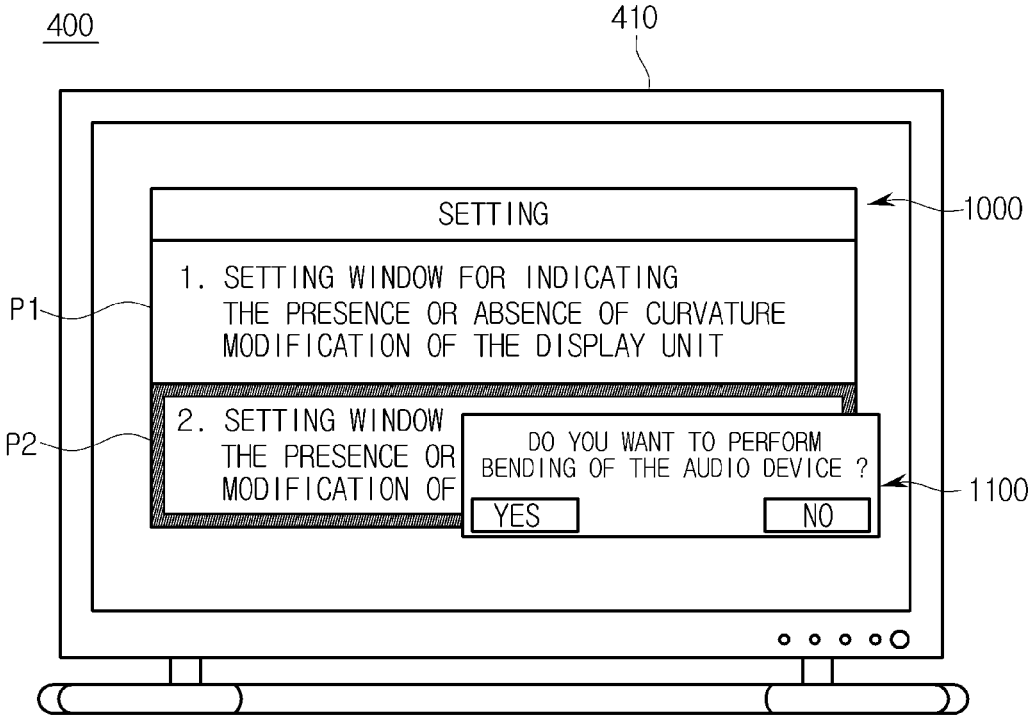

AUDIO DEVICE

TECHNICAL FIELD

Embodiments of the present invention relate to an audio device, and more particularly to an audio device having an improved bendable structure.

BACKGROUND ART

An audio device is a device for recording/reproducing an audio signal in/from a recording medium, for example, a cassette tape, a record, a disc, a universal serial bus (USB), etc.

Generally, the audio device basically includes a turntable, a tuner, an amplifier, a cassette deck, a speaker unit, etc. If necessary, the audio device may further include an equalizer, a compact disc player, etc.

The tuner, the amplifier, and the cassette deck of the audio device may be integrated into one main body. In addition, the audio device may include a component system in which a music center separated from only a speaker, a turntable, a tuner, an amplifier, a cassette deck, and a speaker unit are separated from one another. In addition, the audio device may include a speaker-amplifier integrated system composed of an amplifier and a speaker unit, configured to receive a sound source from an external part.

In recent times, with the widespread use of an audio/video (A/V) device in which an audio device and a video device are integrated, the number of audio devices, each of which is installed along with a video device having a display unit, is rapidly increasing. Therefore, there is a need to arrange the audio devices to suit the display units.

In addition, a vibration unit mounted to the audio device is fixed, such that the audio device has difficulty in providing a user with rich sound and a rich sound field effect.

DISCLOSURE OF INVENTION

Technical Problem

It is an aspect of the present invention to provide an audio device having an improved structure configured to adjust a sound traveling direction.

It is another aspect of the present invention to provide an audio device having an improved structure such that stereophonic sound and the sound field effect can be provided to a user.

It is another aspect of the present invention to provide an audio device having an improved structure such that the audio device can be arranged to suit peripheral devices.

Additional aspects of the invention will be set forth in part in the description which follows and, in part, will be obvious from the description, or may be learned by practice of the invention.

Solution to Problem

In accordance with an aspect of the present invention, an audio device includes: an amplifier unit configured to amplify an audio signal; at least one speaker unit configured to output the amplified audio signal as a sound signal; and at least one link unit rotatably connecting the at least one speaker unit to the amplifier unit.

The at least one speaker unit may be arranged to rotate on the basis of a separate rotation shaft.

The at least one link unit may include a connection member through which the amplifier unit is connected to at least one speaker unit adjacent to the amplifier unit among the at least one speaker unit so as to control a rotation operation of the at least one adjacent speaker unit.

The at least one speaker unit may be arranged to rotate on the basis of a separate rotation shaft; and the connection member may be arranged to be movable along a direction of the rotation shaft.

The at least one link unit may include: a drive unit configured to provide a driving force by which the at least one speaker unit rotates; and a gear unit disposed between the drive unit and the connection member in such a manner that the gear unit rotates.

The gear unit may include: a first gear coupled to a drive shaft of the drive unit; and a second gear coupled to the connection member.

The connection member may include: a guide rail extended along the rotation shaft direction in such a manner that the second gear is rotatably coupled to the guide rail.

The at least one speaker unit may include a rib formed to protrude along the drive shaft direction; and the connection member may further include a switching guide coupled to the rib.

The switching guide may be gradually tilted toward the guide rail as it gradually moves in a first direction along the rotation shaft direction.

The connection member may move either in the first direction or in a second direction different from the first direction along the rotation shaft direction in response to rotation of the second gear; and if the connection member moves in the first direction, the at least one speaker unit may rotate in one direction along the drive shaft direction on the basis of the rotation shaft.

If the connection member may move in the second direction, the at least one speaker unit may rotate in another direction along the drive shaft direction on the basis of the rotation shaft.

The at least one speaker unit may include a first speaker unit and a second speaker unit that include a plurality of ribs formed to protrude along the drive shaft direction in such a manner that the first speaker unit and the second speaker unit are spaced apart from each other; and the connection member may include a support guide coupled to any one of the plurality of ribs contained in the first speaker unit, and a switching guide coupled to any one of the plurality of ribs contained in the second speaker unit.

The switching guide may be gradually tilted toward the guide rail as it gradually moves in a first direction along the rotation shaft direction; and if the connection member moves in the first direction, the first speaker unit and the second speaker unit may be configured to rotate in one direction along the drive shaft direction on the basis of the rotation shaft.

If the connection member moves in a second direction different from the first direction along the rotation shaft direction, the first speaker unit and the second speaker unit may be configured to rotate in another direction along the drive shaft direction on the basis of the rotation shaft.

The gear unit may further include: at least one third gear arranged to transmit rotational force of the first gear to the second gear.

The amplifier unit may include a projection formed to protrude along the drive shaft direction; and the connection member further includes a support guide coupled to the projection.

In accordance with another aspect of the present invention, an audio device for outputting an audio signal as a sound signal includes: a plurality of rotation shafts arranged in a forward direction; and a plurality of units coupled to be curved on the basis of the plurality of rotation shafts.

The plurality of rotation shafts may be integrated with the plurality of units.

The audio device may further include: at least one link unit arranged in a backward direction in such a manner that the plural units are rotatably connected to the at least one link unit.

The at least one link unit may include: a connection member arranged to be movable along the plurality of rotation shaft directions so as to control a rotation operation of the plurality of units.

The plurality of units may include protrusion units formed to protrude backward; and the connection member includes a support guide coupled to any one of the protrusion units from among the plurality of units, and a switching guide coupled to the other one of the protrusion units from among the plurality of units.

The connection member may further include: a guide rail extended along the plurality of rotation shaft directions in such a manner that the guide rail is disposed between the support guide and the switching guide.

The switching guide may be extended along the plurality of rotation shaft directions in such a manner that a spacing distance between the switching guide and the guide rail is gradually reduced as the switching guide gradually moves in a first direction along the plurality of rotation shaft directions.

The plural units spaced apart from each other may be connected to the plurality of rotation shafts and the connection member such that the plural units rotate on the basis of the plurality of rotation shafts; and if the connection member moves in the first direction, the plural units may rotate in a forward direction on the basis of the plurality of rotation shafts, and a spacing distance between the plural units is gradually increased as the plural units are located closer to a rear end.

The plural units spaced apart from each other may be connected to the plurality of rotation shafts and the connection member such that the plural units rotate on the basis of the plurality of rotation shafts; and if the connection member moves in the second direction different from the first direction along the plurality of rotation shaft directions, the plural units may rotate in a backward direction on the basis of the plurality of rotation shafts, and a spacing distance between the plural units may be gradually reduced as the plural units are located closer to a rear end.

The at least one link unit may further include a pinion rotatably coupled to the guide rail, and the connection member may move along the plurality of rotation shaft directions because the pinion is rotatably meshed with a rack contained in the guide rail.

The plurality of units may include: an amplifier unit fixed to amplify an audio signal; and at least one speaker unit including not only the at least one vibration unit configured to output the amplified audio signal but also at least one speaker unit rotatably coupled to the amplifier unit.

In accordance with another aspect of the present invention, an audio device for outputting an audio signal as a sound signal includes: a fixed unit; and a plurality of rotation units rotatably coupled to the fixed unit.

The audio device may further include: a link unit connected to the plurality of rotation units in such a manner that the plural rotation units are curved in the same direction with respect to a longitudinal direction of the audio device.

The plurality of rotation units may be connected to the fixed unit in such a manner that the plural rotation units rotate on the basis of a rotation shaft. The link unit may include: a link, one end of which is coupled to the rotation shaft, such that the link moves in a forward or backward direction; and a transmission member coupled to the other end of the link in such a manner that the transmission member rotates.

The link unit may include a first link unit coupled to any one of the plural rotation units and a second link unit coupled to the other one of the plural rotation units. A transmission member of the first link unit and a transmission member of the second link unit may include gear units rotatably meshed with each other in such a manner that movement of any one of the plural rotation units is transferred to the other one of the plural rotation units.

The plural rotation units may include: a first unit in which a first rotation shaft coupled to the fixed unit is provided; a second unit coupled to a second rotation shaft provided to the first unit in such a manner that the second unit is spaced apart from the first rotation shaft; and a connection unit configured to interconnect the first unit and the second unit in such a manner that the first unit and the second are curved in the same direction with respect to a longitudinal direction of the audio device.

The connection unit may include a rod contained in the first unit in such a manner that the rod moves along a longitudinal direction of the audio device.

The connection unit may include: a first transmission gear configured to connect the fixed unit to one end of the rod arranged toward the fixed unit; and a second transmission gear configured to connect the second unit to the other end of the rod arranged toward the second unit.

The first transmission gear and the second transmission gear may rotate in different directions.

The first transmission gear may be rotatably meshed with not only a first serration unit provided at one end of the fixed unit adjacent to the first unit but also a first teeth unit provided at one end of the rod arranged toward the fixed unit.

The second transmission gear may be rotatably meshed with not only a second serration unit provided at one end of the second unit adjacent to the first unit but also a second teeth unit provided at the other end of the rod arranged toward the second unit.

If the first unit and the second unit are curved in a forward direction, the rod may move in a first direction moving distant from the fixed unit in a longitudinal direction of the audio device. If the first unit and the second unit are curved in a backward direction, the rod may move in a second direction moving closer to the fixed unit in a longitudinal direction of the audio device.

In accordance with another aspect of the present invention, an audio device includes: an amplifier unit configured to process an audio signal; a speaker unit coupled to the amplifier unit simultaneously while being curved in a forward direction with respect to the amplifier unit such that the speaker unit outputs the audio signal processed by the amplifier unit as a sound signal; and a casing configured to accommodate the amplifier unit and the speaker unit.

The speaker unit may be symmetrically or asymmetrically coupled to the amplifier unit with respect to a longitudinal direction of the audio device.

The audio device may further include: a drive unit configured to adjust a bending degree or bending direction of the speaker unit with respect to the amplifier unit; and a controller configured to control the drive unit.

The audio device may further include: a plurality of link units configured to discriminate between the amplifier unit and the speaker unit.

The audio device may further include: a link unit for connecting the speaker unit to the amplifier unit in such a manner that the speaker unit is curved on the basis of a separate rotation shaft.

The audio device may further include: a drive unit configured to provide a driving force to the link unit in such a manner that the link unit is curved along with the speaker unit with respect to the amplifier unit.

Advantageous Effects of Invention

The audio device according to the embodiment of the present invention has a bendable structure, such that the bendable audio device can be arranged to suit the shapes of peripheral devices capable of being used with the audio device.

The audio device includes a plurality of units rotatably interconnected on the basis of a separate rotation shaft, can adjust a sound traveling direction to suit user interest or preference, such that rich sound and the rich sound field effect can be provided to the user.

The degree of rotation of the audio device and the degree of bending of the audio device can be automatically adjusted, resulting in convenience in use of the audio device.

The degree of rotation of the audio device and the degree of bending of the audio device can be manually adjusted, such that an additional energy source for adjusting the sound traveling direction can be omitted, resulting in energy saving.

BRIEF DESCRIPTION OF DRAWINGS

These and/or other aspects of the disclosure will become apparent and more readily appreciated from the following description of the embodiments, taken in conjunction with the accompanying drawings of which:

FIG. 1 is a perspective view illustrating the external appearance of an audio device according to a first embodiment of the present invention.

FIG. 2 is a perspective view illustrating some parts of a first unit of the audio device according to a first embodiment of the present invention.

FIGS. 3A and 3B are enlarged views illustrating some parts of FIG. 2.

FIG. 4A is a plan view illustrating the audio device from which a first casing is omitted according to a first embodiment of the present invention.

FIG. 4B is a plan view illustrating an enlarged structure of some parts of FIG. 4A.

FIGS. 5A and 5B are exploded perspective views illustrating the audio device according to a first embodiment of the present invention.

FIG. 6 is a perspective view illustrating a first shape of the audio device according to a first embodiment of the present invention.

FIG. 7 is a plan view illustrating the first shape shown in FIG. 6 from which a first casing is omitted.

FIG. 8 is a perspective view illustrating a second shape of the audio device according to a first embodiment of the present invention.

FIG. 9 is a plan view illustrating the second shape shown in FIG. 8 from which a first casing is omitted.

FIG. 10 is a plan view illustrating the audio device from which a first casing is omitted according to a second embodiment of the present invention.

FIGS. 11A to 11D are perspective views illustrating various shapes of the audio device according to a second embodiment of the present invention.

FIG. 12 is a perspective view illustrating the external appearance of the audio device according to a third embodiment of the present invention.

FIG. 13 is a rear view illustrating an audio device according to a third embodiment of the present invention.

FIG. 14 is an exploded perspective view illustrating a link unit of the audio device according to a third embodiment of the present invention.

FIG. 15 is a perspective view illustrating an enlarged structure of the link unit of the audio device according to a third embodiment of the present invention.

FIG. 16 is a rear view illustrating that the audio device is bent in one direction according to a third embodiment of the present invention.

FIG. 17 is a plan view illustrating the shape of the audio device shown in FIG. 16.

FIG. 18 is a rear view illustrating that the audio device is bent in the other direction according to a third embodiment of the present invention.

FIG. 19 is a plan view illustrating the shape of the audio device shown in FIG. 18.

FIGS. 20A to 20D are plan views illustrating various shapes of the audio device according to a third embodiment of the present invention.

FIG. 21 is a perspective view illustrating an arrangement structure of the audio device shown in the third embodiment and a peripheral device.

FIG. 22 is a control block diagram illustrating the audio device shown in the third embodiment and a peripheral device.

FIG. 23 is a flowchart illustrating a method for controlling the audio device shown in the third embodiment of the present invention.

FIG. 24 illustrates curvature modification setting windows for both a display unit of a peripheral device and an audio device such that the curvature modification setting windows are displayed on the display unit of the peripheral device and the bending degree of the audio device of the third embodiment can be adjusted in association with the peripheral device.

FIGS. 25A and 25B are conceptual diagrams illustrating a method for establishing the presence or absence of curvature modification of the audio device shown in the third embodiment of the present invention.

MODE FOR THE INVENTION

Reference will now be made in detail to the embodiments of the present invention, examples of which are illustrated in the accompanying drawings, wherein like reference numerals refer to like elements throughout.

The audio device according to the following embodiments will hereinafter be described with reference to the attached drawings. Terms such as "front end", "rear end", "upper part," "lower part," "upper end," and "lower end" are defined based on the drawings and do not limit shapes and positions of components.

The embodiments of the present invention can be applied to various audio devices (1, 1*a*, 1*b*). For convenience of description and better understanding of the present invention, the following embodiments will hereinafter be described on the basis of the speaker-amplifier integrated system.

FIG. 1 is a perspective view illustrating the external appearance of an audio device according to a first embodiment of the present invention.

Referring to FIG. 1, the audio device 1 may be formed in a bar shape. However, the shape of the audio device 1 is not limited thereto.

The audio device 1 may include the casings (10, 20) forming the external appearance thereof.

The casings (10, 20) may include a first casing 10 and a second casing 20 coupled to each other in the direction (X) of a rotation shaft. The first casing 10 may be disposed at an upper part of the rotation shaft direction (X), and the second casing 20 may be disposed at a lower part of the rotation shaft direction (X). The first casing 10 and the second casing 20 may be detachably coupled to each other.

The first casing 10 may include a first casing 10 forming the external appearance of a fixed unit 40; a first casing 10 forming the external appearance of a first unit 70; and a first casing 10 forming the external appearance of a second unit 80. The second casing 20 may include a second casing 20 forming the external appearance of the fixed unit 40; a second casing 20 forming the external appearance of the first unit 70; and a second casing 20 forming the external appearance of the second unit 80.

The audio device 1 may further include a display unit (not shown) provided to indicate the operation state of the audio device 1. In addition, the audio device 1 may further include a manipulation unit (not shown) configured to turn the audio device 1 on or off as well as to adjust output volume of the audio device 1.

The audio device 1 may further include a plurality of units 30 rotatably coupled to each other.

The plurality of units 30 may be rotatably coupled in the longitudinal direction (L) of the audio device 1. In more detail, the plurality of units 30 may include a fixed unit 40 and a plurality of rotation units 50. The fixed unit 40 may be arranged to maintain a fixed state. The plurality of rotation units 50 may be rotatably coupled to the fixed unit 40.

An amplifier (not shown) for amplifying an audio signal may be provided in the fixed unit 40. In more detail, the amplifier (not shown) may be embedded into the fixed unit 40, such that the amplifier may receive the audio signal from the peripheral device (shown in FIG. 21), amplify the received audio signal, and output the amplified audio signal to at least one vibration unit 51.

At least one vibration unit 51 may be provided in the plurality of rotation units 50 such that the vibration unit 51 can output the amplified audio signal as a sound signal. At least one vibration unit 51 may be provided at the front surface of the audio device 1. In more detail, at least one vibration unit 51 may be provided to the front surface of the plurality of rotation units 50. As described above, at least one vibration unit 51 is provided to a plurality of rotation units 50 rotatably coupled to the fixed unit 40, such that the user can adjust the rotation direction or the rotation angle of the plurality of rotation units 50 so as to adjust the sound traveling direction. At least one vibration unit 51 may include a tweeter for outputting a high pitched sound and a woofer for outputting a medium-low pitched sound.

The plurality of rotation units 50 may include a first unit 70 rotatably coupled to the fixed unit 40; and a second unit 80 rotatably coupled to the first unit 70. The number of plural rotation units 50 is not limited to 2, and can be set to other numerals.

The audio device 1 may have a symmetrical structure. The audio device 1 may have a symmetrical structure on the basis of the fixed unit 40. The plurality of rotation units 50 may be rotatably coupled to both ends of the fixed unit 40. However, the scope or spirit of the audio device 1 is not limited to the symmetrical structure, and the shape of the audio device 1 can be modified in various ways without departing from the scope or spirit of the present invention.

FIG. 2 is a perspective view illustrating some parts of a first unit of the audio device according to a first embodiment of the present invention. FIGS. 3A and 3B are enlarged views illustrating some parts of FIG. 2. FIG. 4A is a plan view illustrating the audio device from which a first casing is omitted according to a first embodiment of the present invention. FIG. 4B is a plan view illustrating an enlarged structure of some parts of FIG. 4A. FIGS. 5A and 5B are exploded perspective views illustrating the audio device according to a first embodiment of the present invention.

Referring to FIGS. 2 to 5B, the plurality of rotation units 50 may be arranged to rotate on the basis of the rotation shaft 60.

The rotation shaft 60 may include a first rotation shaft 61 and a second rotation shaft 62. The first rotation shaft 61 and the second rotation shaft 62 may be provided in the first unit 70.

The first unit 70 may include a vibration unit seating unit 71 to which at least one vibration unit 51 can be mounted. In more detail, the vibration unit seating unit 71 may be formed in the first casing 10 of the first unit 70 such that the front surface of the vibration unit seating unit 71 can be opened.

In addition, a first rotation shaft 61 extended downward in the rotation shaft direction (X) may be mounted to the first unit 70. The first rotation shaft 61 may be provided to the first casing 10 of the first unit 70 such that the first rotation shaft 61 can be extended downward in the rotation shaft direction (X). The first rotation shaft 61 may be integrated with the first casing 10 of the first unit 70. The first rotation shaft 61 may be fixed to the first rotation shaft coupling unit 72 mounted to the second casing 20 of the first unit 70.

In addition, a second rotation shaft 62 extended downward in the rotation shaft direction (X) may be provided to the first unit 70. The second rotation shaft 62 may be provided to the first casing 10 of the first unit 70 such that the second rotation shaft 62 can be extended downward in the rotation shaft direction (X). The second rotation shaft 62 may be spaced apart from the first rotation shaft 61 by a predetermined distance. The second rotation shaft 62 may be integrated with the first casing 10 of the first unit 70. The second rotation shaft 62 may be fixed to the second rotation shaft coupling unit 73 mounted to the second casing 20 of the first unit 70.

A connection seating unit 74 capable of being mounted to the connection unit 90 may be provided to the first unit 70. The connection seating unit 74 may be provided to the first casing 10 of the first unit 70. In more detail, the connection unit 90 may be mounted to the connection seating unit 74 provided to an inner wall of the first casing 10 of the first unit 70.

In addition, a plurality of fixed protrusion units (75, 76) extended downward in the rotation shaft direction (X) may be provided to the first unit 70. The plurality of fixed protrusion units (75, 76) may include a first fixed protrusion unit 75 coupled to the fixed unit 40 and a second fixed protrusion unit 76 coupled to the second unit 80. In more detail, the first fixed protrusion unit 75 may be coupled to the first fixed protrusion coupling unit 41 formed in the second casing 20 of the second unit 40. The second fixed protrusion unit 76 may be coupled to the second fixed protrusion coupling unit 81 formed in the second casing 20 of the second unit 80. The first fixed protrusion unit 75 may be arranged adjacent to the first rotation shaft 61. The second fixed protrusion unit 76 may be arranged adjacent to the second rotation shaft 62. The first fixed protrusion unit 75 and the second fixed protrusion unit 76 may be integrated with the first casing 10 of the first unit 70.

The fixed unit 40 may include a fastening pillar unit 42. The fastening pillar unit 42 may be provided at both ends of the fixed unit 40 such that the fastening pillar unit 42 protrudes toward the first unit 70. The fastening pillar unit 42 may be formed by combination of the first casing 10 and the second casing 20 of the fixed unit 40.

A first rotation shaft through-hole 43 through which the first rotation shaft 61 can pass may be formed in the fastening pillar unit 42. The first rotation shaft through-hole 43 may be provided in the first casing 10 and the second casing 20 of the fixed unit 40 such that the first rotation shaft 61 can sequentially pass through the first casing 10 and the second casing 20 of the fixed unit 40 so that the first rotation shaft 61 can be fixed to the first rotation shaft coupling unit 72 formed in the second casing 20 of the first unit 70.

The first fixed protrusion 75 may be coupled to the fastening pillar unit 42. The first fixed protrusion coupling unit 41 may be formed in the fastening pillar unit 42. The first fixed protrusion coupling unit 41 may be formed in the fastening pillar unit 42 such that the first fixed protrusion coupling unit 41 can be adjacent to the first rotation shaft through-hole 43. The first fixed protrusion unit 75 may pass through the first casing 10 of the fixed unit 40 so that the first fixed protrusion unit 75 can be coupled to the first fixed protrusion coupling unit 41 formed in the second casing 20 of the fixed unit 40.

A first serration unit 44 may be mounted to the fastening pillar unit 42. In other words, the first serration unit 44 may be provided to one end of the fixed unit 40 adjacent to the first unit 70. The first serration unit 44 may be provided to the fastening pillar unit 42 of the first casing 10 of the fixed unit 40. The first serration unit 44 may be provided to the fastening pillar unit 42 of the first casing 10 of the fixed unit 40 in such a manner that the first serration unit 44 can be disposed at the outside of the radial direction of the first rotation shaft through-hole 43.

A first auxiliary serration unit 45 may be provided to the fastening pillar unit 42. In other words, the first auxiliary serration unit 45 may be located downward of the first serration unit 44 in the rotation shaft direction (X). The first auxiliary serration unit 45 may be provided to the fastening pillar unit 42 of the second casing 20 of the fixed unit 40. The first auxiliary serration unit 45 may be provided to the fastening pillar unit 42 of the second casing 20 of the fixed unit 40 such that the first auxiliary serration unit 45 can be located at the outside of the radial direction of the first rotation shaft through-hole 43. The first auxiliary serration unit 45 may be rotatably meshed with a first auxiliary gear 77 provided to the second casing 20 of the first unit 70.

A shaft 111 of a transfer member 110 may be provided to the fixed unit 40. The shaft 111 of the transfer member 110 may be provided to the fixed unit 40 such that the shaft 111 can be extended downward in the rotation shaft direction (X). In more detail, the shaft 111 of the transfer member 110 may be provided to the first casing 10 of the fixed unit 40 such that the shaft 111 can be extended downward in the rotation shaft direction (X). The shaft 111 of the transfer member 110 may be integrated with the first casing 10 of the fixed unit 40.

A transfer member fixing unit 46 capable of being coupled to the transfer member 110 may be provided to the fixed unit 40. The transfer member fixing unit 46 may be provided to the second casing 20 of the fixed unit 40. A shaft coupling hole 47 in which the shaft 111 of the transfer member 110 can be inserted may be formed in the transfer member fixing unit 46. The transfer member 110 may be coupled to the transfer member fixing unit 46 such that the transfer member 110 can rotate on the basis of the shaft 111 of the transfer member 110 inserted into the shaft coupling hole 47.

A vibration unit seating unit 71 may be provided in the second unit 80 such that at least one vibration unit 51 can be seated in the vibration unit seating unit 71. In more detail, the first casing 10 of the second unit 80 is coupled to the second casing 20 of the second unit 80, such that the vibration unit seating unit 71*a* having an opened front surface may be formed.

In addition, the second unit 80 may include a coupling pillar unit 82. The coupling pillar unit 82 may be provided at one end of the second unit 80 such that the coupling pillar unit 82 can protrude toward the first unit 70. That is, the coupling pillar unit 82 may be provided at one end of the second unit 80 adjacent to the first unit 70. The coupling pillar unit 82 may be formed by combination of the first casing 10 and the second casing 20 of the second unit 80.

A second rotation shaft through-hole 83 may be formed in the coupling pillar unit 82 such that the second rotation shaft through-hole 83 can pass through the second rotation shaft 62. The second rotation shaft through-hole 83 may be provided to the first casing 10 and the second casing 20 of the second unit 80 such that the second rotation shaft 62 can successively pass through the first casing 10 and the second casing 20 of the second unit 80 so that the second rotation shaft 62 can be fixed to the second rotation shaft coupling unit 83 formed in the second casing 20 of the second unit 80.

The second fixed protrusion unit 76 may be coupled to the coupling pillar unit 82. The second fixed protrusion coupling unit 81 may be formed in the coupling pillar unit 82. The second fixed protrusion coupling unit 81 may be formed in the coupling pillar unit 82 such that the second fixed protrusion coupling unit 81 is adjacent to the second rotation shaft through-hole 83. The second fixed protrusion unit 76 passes through the first casing 10 of the second unit 80, such that the second fixed protrusion unit 76 can be coupled to the second fixed protrusion coupling unit 81 formed in the second casing 20 of the second unit 80.

A second serration unit 84 may be provided to the coupling pillar unit 82. In other words, the second serration unit 84 may be provided at one end of the second unit 80 adjacent to the first unit 70. The second serration unit 84 may be provided to the coupling pillar unit 82 of the first casing 10 of the second unit 80. The second serration unit 84 may be provided to the coupling pillar unit 82 of the first casing 10 of the second unit 80 such that the second serration unit 84 can be located at the outwards in the radial direction of the second rotation shaft through-hole 83.

A second auxiliary serration unit 85 may be provided to the coupling pillar unit 82. In other words, the second auxiliary serration unit 85 may be located downward of the second serration unit 84 in the rotation shaft direction (X). The second auxiliary serration unit 85 may be provided to the coupling pillar unit 82 of the second casing 20 of the second unit 80. The second auxiliary serration unit 85 may be provided to the coupling pillar unit 82 of the second casing 20 of the second unit 80 such that the second auxiliary serration unit 85 can be located at the outwards in the radial direction of the second rotation shaft through-hole 83. The second auxiliary serration unit 85 may be rotatably meshed with the second auxiliary gear 78 provided in the second casing 20 of the first unit 70. The second auxiliary gear 78 may be provided to the second casing 20 of the first unit 70 such that the second auxiliary gear 78 can be spaced apart from the first auxiliary gear 77.

The audio device 1 may further include a link unit 100 coupled to a plurality of rotation units 50 such that the plurality of rotation units 50 can be bent in the same direction with respect to the longitudinal direction (L) of the audio device 1. That is, the link unit 100 may be coupled to the plurality of rotation units 50 such that the plural rotation units 50 are integrated and bent forward or backward of the audio device 1.

The link unit 100 may be provided in the fixed unit 40.

The link unit 100 may include a link 120 and a transfer member 110.

The link 120 may be movable in a forward or backward direction.

The link 120 may couple the first rotation shaft 61 to the transfer member 110. One end of the link 120 may be coupled to the first rotation shaft 61, and the other end of the link 120 may be coupled to the transfer member 110. One end of the link 120 may be coupled to the first rotation shaft 61, and may be disposed between the first casing 10 and the second casing 20 of the fixed unit 40.

The transfer member 110 may be rotatably coupled to the transfer member fixing unit 46 formed in the second casing 20 of the fixed unit 40. The transfer member may be coupled to a cover 112. The transfer member 110 may be coupled to the cover 112 in the rotation shaft direction (X). That is, the transfer member 110 may be disposed downward of the cover 112 in the rotation shaft direction (X). The link 120 may be disposed between the transfer member 110 and the cover 112. In other words, the other end of the link 120 coupled to the transfer member 110 may be disposed between the transfer member 110 and the cover 112. A link shaft 121 may be provided at the other end of the link 120 coupled to the transfer member 110. The link shaft 121 may couple the transfer member 110 to the cover 112. A gear unit 113 may be formed in the transfer member 110.

A plurality of link units 100 may be configured. Each link unit 100 may include a first link unit 130 coupled to any one of the plurality of rotation units 50 and a second link unit 140 coupled to the other one of the plurality of rotation units 50. The first link unit 130 and the second link unit 140 may function as a temporary bridge through which the movement of any one of the plural rotation units 50 can be transferred to the other one of the plural rotation units 50. The first link unit 130 and the second link unit 140 may be arranged to face each other in the longitudinal direction (L) of the audio device 1. In more detail, the first link unit 130 and the second link unit 140 may be disposed in the fixed unit 40 such that the gear unit 113 of the transfer member 110 of the first link unit 130 can be rotatably meshed with the gear unit 113 of the transfer member 110 of the second link unit 140. Since the gear unit 113 of the transfer member 110 of the first link unit 130 is rotatably meshed with the gear unit 113 of the transfer member 110 of the second link unit 140, movement of any one of the plural rotation units 50 can be transferred to the other one of the plural rotation units 50, such that the plural rotation units 50 can be bent in the same direction with respect to the longitudinal direction (L) of the audio device 1.

The plurality of rotation units 50 may further include a connection unit 90 for interconnecting the first unit 70 and the second unit 80 such that the first unit 70 and the second unit 80 can be bent in the same direction with respect to the longitudinal direction (L) of the audio device 1. If the audio device 1 includes the connection unit 90 and the link unit 100, the audio device 1 may be bent in the same direction with respect to the longitudinal direction (L) of the audio device 1.

The connection unit 90 may be provided in the first unit 70. In more detail, the connection unit 90 may be mounted to the connection seating unit 74 of the first casing 10 of the first unit 70.

The connection unit 90 may include a rod 91. The rod 91 may be provided in the first unit 70 such that the rod 91 can move in the longitudinal direction (L) of the audio device 1. In more detail, if the first unit 70 and the second unit 80 are bent forward, the rod 91 may move in the first direction (A) that is gradually spaced apart from the fixed unit 40 in the longitudinal direction (L) of the audio device 1. In addition, if the first unit 70 and the second unit 80 are bent backwards, the rod 91 may move in the second direction (B) to gradually approach the fixed unit 40 in the longitudinal direction (L) of the audio device 1.

A plurality of teeth units (92*a*, 92*b*, 92*c*) may be formed in the rod 91.

The teeth units (92*a*, 92*b*, 92*c*) may include a first teeth unit 92*a*, a second teeth unit 92*b*, and a third teeth unit 92*c*.

The first teeth unit 92*a* may be provided at one end of the rod 91 arranged in the fixed unit 40. In other words, the first teeth unit 92*a* may be provided at one end of the rod 91 arranged in the second direction (B). In addition, the first teeth unit 92*a* may be provided at one end of the rod 91 so that the first teeth unit 92*a* may be disposed in a forward direction.

The second teeth unit 92*b* may be provided at the other end of the rod 91 arranged in the second unit 80. In other words, the second teeth unit 92*b* may be provided at the other end of the rod 91 arranged in the first direction (A). In addition, the second teeth unit 92*b* may be provided at the other end of the rod 91 such that the second teeth unit 92*b* may be disposed in a backward direction.

The third teeth unit 92*c* may be provided in the rod 91 such that the third teeth unit 92*c* can be disposed between the first teeth unit 92*a* and the second teeth unit 92*b*. At least one third teeth unit 92*c* may be provided. The third teeth unit 92*c* may be provided in the rod 91 such that the third teeth unit 92*c* may be disposed in a forward direction.

The connection unit 90 may further include a plurality of transmission gears (93, 94). The plurality of transmission gears (93, 94) may include a first transmission gear 93 and a second transmission gear 94.

The first transmission gear 93 may connect the first unit 40 to one end of the rod 91 arranged toward the fixed unit 40. That is, the first transmission gear 93 may connect the fixed unit 40 to one end of the rod 91 arranged in the second direction (B). The first transmission gear 93 may be disposed between the first serration unit 44 formed in the first casing 10 of the fixed unit 40 and the first teeth unit 92*a* provided to one end of the rod 91 arranged toward the fixed unit 40. In more detail, the first transmission gear 93 may be arranged in the first unit 70 such that the first transmission gear 93 can be rotatably meshed with the first serration unit 44 and the first teeth unit 92*a*. In another aspect of the present invention, the first transmission gear 93 may include a first annexed gear 93*a* and a second annexed gear 93*b* that are arranged to rotate on the basis of one rotation shaft (not shown). The first annexed gear 93*a* may be disposed upward of the second annexed gear 93*b* in the rotation shaft direction (X). The first annexed gear 93*a* may be rotatably meshed with the first teeth unit 92*a* of the rod 91, and the second annexed gear 93*b* may be rotatably meshed with the first teeth unit 44. The number of serration shapes contained in the first annexed gear 93*a* may be different from the number of serration shapes contained in the second annexed gear 93*b*. The number of serration shapes contained in the first annexed gear 93*a* may be higher than the number of serration shapes contained in the second annexed gear 93*b*. However, the number of serration shapes of the first and second annexed gears 93*a* and 93*b* and the arrangement structures of the first and second annexed gears 93*a* and 93*b* are not limited thereto.

The second transmission gear 94 may connect the second unit 80 to the other end of the rod 91 arranged toward the second unit 80. That is, the second transmission gear 94 may connect the second unit 80 to the other end of the rod 91 arranged in the first direction (A). The second transmission gear 94 may be disposed between the second serration unit 84 formed in the first casing 10 of the second unit 80 and the second teeth unit 92*b* provided to one end of the rod 91 arranged toward the second unit 80. In more detail, the second transmission gear 94 may be arranged in the first unit 70 such that the second transmission gear 94 can be rotatably meshed with the second teeth unit 84 and the second teeth unit 92*b*. In another aspect of the present invention, the second transmission gear 94 may include a first annexed gear 94*a* and a second annexed gear 94*b* arranged to rotate on the basis of one rotation shaft (not shown). The first annexed gear 94*a* may be disposed upward of the second annexed gear 94*b* in the rotation shaft direction (X). The first annexed gear 94*a* may be rotatably meshed with the second teeth unit 92*b* of the rod 91, and the second annexed gear 94*b* may be rotatably meshed with the second serration unit 84. The number of serration shapes contained in the first annexed gear 94*a* may be different from the number of serration shapes contained in the second annexed gear 94*b*. The number of serration shapes of the first annexed gear 94*a* may be less than the number of serration shapes of the second annexed gear 94*b*. However, the number of serration shapes of the first and second annexed gears 94*a* and 94*b* and the arrangement structure of the first and second annexed gears 94*a* and 94*b* are not limited thereto.

The number of serration shapes of the first annexed gear 93*a* of the first transmission gear 93 may be higher than the number of serration shapes of the first annexed hear 94*a* of the second transmission gear 94. In addition, the number of serration shapes of the second annexed gear 93*b* of the first transmission gear 93 may be less than the number of serration shapes of the second annexed gear 94*b* of the second transmission gear 94. However, the relationship between the number of serrations of the first transmission gear 93 and the number of serrations of the second transmission gear 94 is not limited thereto, and can be modified in various ways without departing from the scope or spirit of the present invention.

The first transmission gear 93 and the second transmission gear 94 may rotate in different directions. That is, if the first transmission gear 93 rotates clockwise, the second transmission gear 94 may rotate counterclockwise. In contrast, if the first transmission gear 93 rotates counterclockwise, the second transmission gear 94 may rotate clockwise.

The connection unit 90 may further include at least one connection gear 95. At least one connection gear 95 may be arranged in the first unit 70 such that the connection gear 95 can be rotatably meshed with the third teeth unit 92*c* of the rod 91. At least one connection gear 95 may adjust the movement speed of the rod 91. Therefore, at least one connection gear 95 may include an acceleration gear or a deceleration gear.

At least one rotation shaft (not shown) from among the first transmission gear 93, the second transmission gear 94, and at least one connection gear 95 may be formed in the first casing 10 of the first unit 70 such that the at least one rotation shaft can be extended downward of the rotation shaft direction (X). At least one rotation shaft (not shown) from among the first transmission gear 93, the second transmission gear 94, and at least one connection gear 95 may be integrated with the first casing 10 of the first unit 70.

FIG. 6 is a perspective view illustrating a first shape of the audio device according to a first embodiment of the present invention. FIG. 7 is a plan view illustrating the first shape shown in FIG. 6 from which a first casing is omitted. For convenience of description and better understanding of the present invention, other reference numbers (not shown) will refer to constituent elements shown in FIGS. 1 to 5B.

Referring to FIGS. 6 and 7, the audio device 1 may be curved or bent forward. That is, a plurality of rotation units 50 rotatably coupled to the fixed unit 40 may be integrated and then bent in a forward direction. In other words, the audio device 1 may be bent to have a concave shape in a forward direction.

If any one of the plurality of rotation units 50 rotates in a forward direction, the plural rotation units 50 may be integrated and then bent in a forward direction, and as such a detailed description thereof will hereinafter be described in detail. For convenience of description and better understanding of the present invention, it is assumed that the plural rotation units 50 includes a first rotation unit 50 coupled to the left side of the fixed unit 40 and a second rotation unit 50 coupled to the right side of the fixed unit 40.

If the second unit 80 of the first rotation unit 50 is pushed in the forward direction, the second unit 80 of the first rotation unit 50 may rotate counterclockwise on the basis of the second rotation shaft 62 of the first rotation unit 50. In this case, the second transmission gear 94 of the first rotation unit 50 rotatably meshed with the second serration unit 84 of the first rotation unit 50 may rotate clockwise, and the first transmission gear 93 of the first rotation unit 50 may rotate counterclockwise. Since the first transmission gear 93 of the first rotation unit 50 and the second transmission gear 94 of the first rotation unit 50 rotate, the rod 91 of the first rotation unit 50 may perform translational motion in the first direction (A). The first unit 70 of the first rotation unit 50 may rotate clockwise on the basis of the first rotation shaft 61 of the first rotation unit 50, because the first serration unit 44 of the first rotation unit 50 rotatably meshed with the first transmission gear 93 of the first rotation unit 50 rotates clockwise. Accordingly, the transfer member 110 of the first rotation unit 50 connected to the link 120 of the first rotation unit 50 may rotate clockwise. The transfer member 110 of the second rotation unit 50 rotatably meshed with the transfer member 110 of the first rotation unit 50 may rotate counterclockwise. The movement of the transfer member 110 of the second rotation unit 50 may be transferred to the first unit 70 of the second rotation unit 50 through the link 120 of the second rotation unit 50. The first unit 70 of the second rotation unit 50 may rotate counterclockwise on the basis of the first rotation shaft 61 of the second rotation unit 50, and the first transmission gear 93 of the second rotation unit 50 rotatably meshed with the first serration unit 44 of the second rotation unit 50 may rotate counterclockwise. In this case, the second transmission gear 94 of the second rotation unit 50 may rotate counterclockwise, and the rod 91 of the second rotation unit 50 may perform translational motion in the first direction (A). Since the second serration unit 84 of the second rotation unit 50 rotatably meshed with the second transmission gear 94 rotates clockwise, the second unit 80 of the second rotation unit 50 may rotate clockwise on the basis of the second rotation shaft 62. Therefore, the second unit 80 of the second rotation unit 50 may also move in a forward direction.

FIG. 8 is a perspective view illustrating a second shape of the audio device according to a first embodiment of the present invention. FIG. 9 is a plan view illustrating the second shape shown in FIG. 8 from which a first casing is omitted. For convenience of description and better understanding of the present invention, other reference numbers (not shown) will refer to constituent elements shown in FIGS. 1 to 7.

Referring to FIGS. 8 and 9, the audio device 1 may be bent backward. That is, a plurality of rotation units 50 rotatably coupled to the fixed unit 40 may be integrated and then bent backwards. In other words, the audio device 1 may be bent to have a convex shape in a forward direction.

If any one of the plural rotation units 50 may rotate in a backward direction, the plurality of rotation units 50 may be integrated and then bent backward. The bending operation of the plurality of rotation units 50 bent in a backward direction shown in FIGS. 8 and 9 is opposed to the bending operation of the plural rotation units 50 bent in a forward direction shown in FIGS. 6 and 7, and as such a detailed description thereof will herein be omitted for convenience of description and better understanding of the present invention.

FIG. 10 is a plan view illustrating the audio device from which a first casing is omitted according to a second embodiment of the present invention. FIGS. 11A to 11D are perspective views illustrating various shapes of the audio device according to a second embodiment of the present invention. For convenience of description and better understanding of the present invention, other reference numbers (not shown) will refer to constituent elements shown in FIGS. 1 to 7.

Referring to FIGS. 10 to 11D, a link unit 100 for interconnecting the plurality of rotation units 50 may be omitted from the audio device 1*a*. In this case, the plurality of rotation units 50 may be move independently of each other. That is, if the link unit 100 is omitted, the movement of the first rotation unit 50 is not transferred to the second rotation unit 50, such that movement of the first rotation unit 50 and movement of the second rotation unit 50 do not affect each other and such that the units can move independently. However, the first unit 70 and the second unit 80 are interconnected through the connection unit 90, such that the first unit 70 and the second unit 80 may simultaneously move. That is, the first unit 70 and the second unit 80 of the first rotation unit 50 may simultaneously move. Likewise, the first unit 70 and the second unit 80 of the second rotation unit 50 may simultaneously move.

Referring to FIG. 11A, the audio device 1*a* may be elongated in a long shape along the longitudinal direction (L) of the audio device 1*a*.

Referring to FIG. 11B, the audio device 1*a* may be bent forward of the audio device 1*a*. That is, the first rotation unit 60 and the second rotation unit 50 may be bent forward of the audio device 1*a*.

Referring to FIG. 11D, the audio device 1*a* may be bent backward of the audio device 1*a*. That is, the first rotation unit 60 and the second rotation unit 50 may be bent backward of the audio device 1*a*.

Referring to FIG. 11A, the first rotation unit 60 and the second rotation unit 50 may be bent in different directions. In more detail, any one of the first rotation unit 60 and the second rotation unit 50 may be bent forward of the audio device 1*a* on the basis of the fixed unit 40, and the other one may be bent backward of the audio device a.

The audio device 1*a* shown in FIGS. 10 to 11D may be identical in structure to the audio device 1 (shown in FIGS. 1 to 9) from which the link unit 100 is omitted, and as such a detailed description of the audio device 1*a* shown in FIGS. 10 to 11D will herein be omitted for convenience of description.

If the link unit 100 and the connection unit 90 are omitted from the audio device, the first unit 70 and the second unit 80 of the plurality of rotation units 50 of the audio devices (1, 1*a*) may move independently of each other.

FIG. 12 is a perspective view illustrating the external appearance of the audio device according to a third embodiment of the present invention. FIG. 13 is a rear view illustrating an audio device according to a third embodiment of the present invention. FIG. 14 is an exploded perspective view illustrating a link unit of the audio device according to a third embodiment of the present invention. FIG. 15 is a perspective view illustrating an enlarged structure of the link unit of the audio device according to a third embodiment of the present invention. In FIGS. 14 and 15, at least one panel 240 is omitted. The protrusion unit 201 may conceptually include a rib and a projection. That is, the rib may include a protrusion unit 201 provided to at least one speaker unit 220, and the projection may indicate the protrusion unit 201 provided to the amplifier (amp) unit 210.

Referring to FIGS. 12 to 15, the audio device 1*a* may be formed in a bar shape. However, the shape of the audio device 1*b* is not limited thereto.

The audio device 1*b* may include a display unit (not shown) configured to indicate the operation state of the audio device 1*b*. In addition, the audio device 1*b* may further include a manipulation unit (not shown) configured to turn the audio device 1*b* on or off as well as to adjust volume of the audio device 1*b*.

The audio device 1*b* may further include a plurality of units 200 rotatably connected to each other. The plurality of units 200 may be rotatably interconnected in the longitudinal direction (L) of the audio device 1*b*.

The plurality of units 200 may include the amplifier unit 210 and at least one speaker unit 220.

An amplifier (not shown) for amplifying the audio signal may be provided in the amplifier unit 210. In more detail, an amplifier (not shown) may be embedded in the amplifier unit 210, such that the amplifier receives the audio signal from the peripheral device 400 (shown in FIG. 21), amplifies the received audio signal, and outputs the amplified audio signal to at least one vibration unit 230. The amplifier unit 210 may be arranged in a fixed manner.

At least one vibration unit 230 for converting the amplified audio signal into a sound signal may be embedded in at least one speaker unit 220. At least one vibration unit 230 may be provided to the front surface of the audio device 1*b*. In more detail, at least one vibration unit 230 may be provided to the front surface of at least one speaker unit 220. As described above, at least one vibration unit 230 may be mounted to at least one speaker unit 220 rotatably connected to the amplifier unit 200, such that the user can adjust the sound traveling direction by adjusting the rotation direction or the rotation angle of the at least one speaker unit 220. At least one vibration unit 230 may include a tweeter for outputting a high pitched sound and a woofer for outputting a medium-low pitched sound.

At least one speaker unit 220 may be bent toward the amplifier unit 210, and then connected to the amplifier unit 210. That is, at least one speaker unit 220 may be bent in a forward or backward direction of the audio device 1*b*, and then connected to the amplifier unit 210.

At least one speaker unit 220 may be symmetrically or asymmetrically connected to the amplifier unit 210 with respect to the longitudinal direction (L) of the audio device 1*b*. In more detail, if at least one speaker unit 220 is symmetrically connected to the amplifier unit 210, at least one speaker unit 220 may be bent in the same direction with respect to the longitudinal direction (L) of the audio device 1*b*, and then coupled to the amplifier unit 210. If at least one speaker unit 220 is asymmetrically connected to the amplifier unit 210, at least one speaker unit 220 may be bent in another direction with respect to the longitudinal direction (L) of the audio device 1*b*, and then coupled to the amplifier unit 210.

A plurality of units 200 may include a protrusion unit 201. The protrusion unit 201 may be formed in a plurality of units 200 such that the protrusion unit 201 protrudes backward of the audio device 1*b*. In more detail, the protrusion unit 201 may be formed in the edge of a back surface of the plurality of units 200. In accordance with another aspect of the present invention, the plurality of units 200 may include a plurality of protrusion units 201 formed to protrude in a drive-shaft direction (T) in such a manner that the plural units 200 may be spaced apart from each other. That is, a plurality of protrusion units 201 formed to protrude in the drive-shaft direction (T) may be provided in at least one speaker unit 220 such that the plural protrusion units 201 may be spaced apart from each other. In more detail, the at least one speaker unit 220 may include a first speaker unit 221 and a second speaker unit 222 that are combined to rotate on the basis of a plurality of rotation shafts 250. A plurality of protrusion units 201 may be respectively provided to the first speaker unit 221 and the second speaker unit 222. Any one of the protrusion units 201 of the first speaker unit 221 may be movably coupled to a support guide 271, and any one of the protrusion units 201 of the second speaker unit 222 may be movably coupled to a switching guide 272 acting as a direction-changing guide. In addition, a plurality of protrusion units 201 formed to protrude in the drive-shaft direction (T) may be provided to the amplifier unit 210 such that the protrusion units 201 can be spaced apart from each other. The plurality of protrusion units 201 may be spaced apart from each other in the longitudinal direction (L) of the audio device 1*b*.

The audio device 1*b* may further include at least one panel 240. The at least one panel 240 may be coupled to the plurality of units 200 such that design and durability of the audio device 1*b* can be improved. At least one panel 240 may be coupled to the outside of the plurality of units 200. At least one panel 240 may include a front-surface panel 241 and a bottom-surface panel 242. The front-surface panel 241 may be coupled to the front surface of the plurality of units 200. The bottom-surface panel 242 may be coupled to the bottom surface of the plurality of units 200. The front-surface panel 241 may be coupled to the front surface of the plurality of units 200 such that the front-surface panel 241 does not cover at least one vibration unit 230 (i.e., at least one vibration unit 230 is exposed forward). The front-surface panel 241 may be integrated with the plurality of units 200 such that the front-surface panel 241 and the plurality of units 200 can simultaneously move. That is, the front-surface panel 241 may be integrated with the plurality of units 200 and then bent in a forward or backward direction. Therefore, the front-surface panel 241 may be formed of a flexible material. The front-surface panel 241 may include a plastic material. The bottom-surface panel 242 may be integrated with the plurality of units 200 and move simultaneously with the plurality of units 200. That is, the bottom-surface panel 242 may be integrated with the plurality of units 200 and then bent in a forward or backward direction. Therefore, the bottom-surface panel 242 may be formed of a flexible material. The bottom-surface panel 242 may include a plastic material. At least one panel 240 is not limited to the front-surface panel 241 and the bottom-surface panel 242.

The audio device 1*b* may further include a plurality of rotation shafts 250.

The plurality of units 200 may be combined to rotate on the basis of the plurality of rotation shafts 250. In other words, the plurality of units 200 may be arranged to rotate on the basis of a separate rotation shaft 250. In more detail, the amplifier unit 210 may be arranged in a fixed manner. At least one speaker unit 220 may be arranged to rotate on the basis of a separate rotation shaft 250. That is, at least one speaker unit 220 may be connected to or combined with the amplifier unit 210 such that the at least one speaker unit 220 can rotate on the basis of a separate rotation shaft 250.

The plurality of rotation shafts 250 may be arranged forward of the audio device 1*b*. In more detail, the plurality of rotation shafts 250 may be formed at the edge of the front surface of the plurality of units 200.

The plurality of rotation shafts 250 may be integrated with the plurality of units 200.

The plurality of rotation shafts 250 may be formed by combination of the plurality of units 200 contiguous to each other. A pillar unit 251 formed to protrude in the longitudinal direction (L) of the audio device 1*b* may be formed in any one of the plurality of units 200 connected to each other. In more detail, the pillar unit 251 may be formed at the edge of the front surface of any one of the plurality of units 200. In addition, the pillar unit 251 may be formed at the edge of the front surface of any one of the plurality of units 200 such that the pillar unit 251 can be elongated in a long shape along the plurality of rotation shaft directions (X). In addition, the pillar unit 251 may include a head 251*a* protruding upward in the plurality of rotation shaft directions (X) and a tail (not shown) protruding downward. A pillar seating unit 252 coupled to the pillar unit 251 may be provided to the other one of the plurality of units 200 connected to each other. The pillar seating unit 252 may have a shape corresponding to the shape of the pillar unit 251. In more detail, the pillar seating unit 252 may be recessed toward the inner side of the other one of the plurality of units 200 connected to each other. In addition, the pillar seating unit 252 may include a head coupling unit 252*a* coupled to the head 251*a* and a tail coupling unit 252*b* coupled to a tail (not shown). The head coupling unit 252*a* and the tail coupling unit 252*b* may be respectively disposed upward and downward of the pillar seating unit 252 in the plurality of rotation shaft directions (X). The head 251*a* may be inserted into the opening 253*a* provided in the head coupling unit 252*a*. The tail (not shown) may be inserted into the opening 253*b* provided in the tail coupling unit 252*b*.

The audio device 1*b* may further include at least one link unit 260 connected to the plurality of units 200 to be rotatably interconnected. At least one link unit 260 may be connected to at least one of the amplifier unit 210 and at least one speaker unit 220 such that at least one of the amplifier unit 210 and at least one speaker unit 220 can be rotated. In addition, at least one link unit 260 may be connected to at least one speaker unit 220 contiguous to each other such that the at least one speaker unit 220 can be rotated. At least one link unit 260 may be provided to discriminate between the amplifier unit 210 and the at least one speaker unit 220.

At least one link unit 260 may be provided at the rear side of the audio device 1*b*. In more detail, at least one link unit 260 may be provided at the rear side of the plurality of rotation shafts 250.

At least one link unit 260 may be disposed between a plurality of contiguous units 200.

At least one link unit 260 may be coupled to any one of the plurality of contiguous units 200.

In more detail, at least one link unit 260 may be fixed to any one of the plurality of contiguous units 200 by a fixed member (not shown).

At least one link unit 260 may include a connection member 270.

The connection member 270 may be arranged to be movable in the plurality of rotation shaft directions (X) such that the connection member 270 can control the rotation operation of the plurality of units 200. In more detail, the connection member 270 may connect at least one speaker unit 220 to the amplifier units 210 contiguous to each other, and may control the rotation operation of the at least one speaker unit 220. In addition, the connection member 270 may be connected to one or more speaker units 220 contiguous to each other, and may control the rotation operation of at least one speaker unit 220.

The connection member 270 may include a support guide 271 and a switching guide 272 acting as a direction-changing guide.

The support guide 271 may be coupled to any one protrusion unit 201 from among the plurality of units 200, and the switching guide 272 may be coupled to the other protrusion unit 201 from among the plurality of units 200. In more detail, if the connection member 270 connects the amplifier unit 210 to at least one speaker unit 220, the protrusion unit 201 of the amplifier unit 210 may be coupled to the support guide 271. In this case, the protrusion unit 201 of at least one speaker unit 220 may be coupled to the switching guide 272. If the connection member 270 connects one or more speaker units 220 contiguous to each other, any one protrusion unit 201 adjacent to the amplifier unit 210 from among at least one speaker unit 220 may be coupled to the support guide 271. In this case, the other protrusion unit 201 distant from the amplifier unit 210 from among at least one speaker unit 220 may be coupled to the switching guide 272.

A guide rail 273 may be provided to the connection member 270. The guide rail 273 may be provided to the connection member 270 such that the guide rail 273 is disposed between the support guide 271 and the switching guide 272. The guide rail 273 may be extended in a plurality of rotation shaft directions (X).

A rack 274 may be provided to the guide rail 273. The rack 274 may be formed in at least one edge of the guide rail 273. In more detail, the rack 274 may be formed in at least one edge of the guide rail 273 arranged parallel to the plurality of rotation shaft directions (X). The connection member 270 may be movable in the plurality of rotation shaft directions (X) because the pinion 292*b* is rotatably meshed with the rack 274.

The support guide 271 may be formed in the connection member 270 such that the support guide 271 can be elongated in a plurality of rotation shaft directions (X). The support guide 271 and the guide rail 273 may be arranged parallel to each other in the plurality of rotation shaft directions (X). The support guide 271 and the guide rail 273 may be spaced apart from each other by a predetermined distance in the longitudinal direction (L) of the audio device 1*b*.

The switching guide 272 may be provided to the connection member 270 such that the switching guide 272 can be adjacent to the guide rail 273. The switching guide 272 may be arranged at the connection member 270 such that the switching guide 272 can be spaced apart from the guide rail 273.

The switching guide 272 may be extended in the plurality of rotation shaft directions (X). In more detail, the switching guide 272 may be provided to the connection member 270 such that the switching guide 272 can be tilted with respect to the plurality of rotation shaft directions (X). As the switching guide 272 moves closer to the first direction (A) in the plurality of rotation shaft directions (X), the switching guide 272 may be gradually tilted toward the guide rail 273. In accordance with another aspect of the present invention, the switching guide 272 may be provided to the connection member 270 such that the distance from the switching guide 272 to the guide rail 273 is gradually reduced as the switching guide 272 approaches the first direction (A) in the plurality of rotation shaft directions (X).

The switching guide 272 may include a first slide unit 272*a*, a second slide unit 272*b*, and a connection unit 272*c*. The connection unit 272*c* may be disposed between the first slide unit 272*a* and the second slide unit 272*b* such that the first slide unit 272*a* and the second slide unit 272*b* can be connected to each other through the connection unit 272*c*. The first slide unit 272*a* may be arranged upward of the connection unit 272*c* in the plurality of rotation shaft directions (X), and the second slide unit 272*b* may be arranged downward of the connection unit 272*c* in the plurality of rotation shaft directions (X).

The connection unit 272*c* may be arranged parallel to at least one of the guide rail 273 and the support guide 271. The first slide unit 272*a* may be connected to the connection unit 272*c* such that the first slide unit 272*a* can be tilted in a direction closer to the guide rail 273 with respect to the plurality of rotation shaft directions (X). The second slide unit 272*b* may be connected to the connection unit 272*c* such that the second slide unit 272*b* can be tilted toward a direction being distant from the guide rail 273 with respect to the plurality of rotation shaft directions (X).

Groove units (272*d*, 272*e*) may be provided at both ends of the switching guide 272. The groove units (272*d*, 272*e*) may have a specific shape corresponding to the shape of the protrusion unit 201 that moves along the switching guide 272. The groove units (272*d*, 272*e*) may function as a stopper configured to limit movement of the protrusion unit 201 that moves along the switching guide 272. The groove units (272*d*, 272*e*) may include a first groove unit 272*d* formed at one end of the first slide unit 272*a* and a second groove unit 272*e* formed at one end of the second slide unit 272*b*.

At least one link unit 260 may further include a drive unit 280 configured to provide driving force to the at least one speaker unit 220. The drive unit 280 can provide driving force to the at least one link unit 260 such that the at least one link unit 260 can be curved around the amplifier unit 210 along with the at least one speaker unit 220. In more detail, the drive unit 280 may provide driving force to the first gear 291 to be rotated. The drive unit 280 may include a motor 281 and a drive shaft 282 connected to the motor 281. The drive shaft 282 may be coupled to the motor 281 such that one end of the drive shaft 282 is arranged backward of the audio device 1*b*. The connection member 270 may be disposed at the rear side of the drive unit 280 in the drive shaft direction (T).

At least one link unit 260 may further include a gear unit 290. The gear unit 290 may be disposed between the drive unit 280 and the connection member 270 such that the gear unit 290 can be rotated. The gear unit 290 may be connected to the drive unit 280 and the connection member 270.

The gear unit 290 may include a first gear 291 and a second gear 292. The first gear 291 may be coupled to the drive shaft 282 of the drive unit 280. The second gear 292 may be coupled to the connection member 270. In more detail, the second gear 292 may be rotatably coupled to the guide rail 273 of the connection member 270. The connection member 270 may move along the plurality of rotation shaft directions (X) because the second gear 292 is rotatably meshed with the rack 274 provided to the guide rail 273. In more detail, the connection member 270 may move in the first direction (A) or the second direction (B) in the plurality of rotation shaft directions (X) because the second gear 292 is rotatably meshed with the rack 274 of the guide rail 273. The first direction (A) and the second direction (B) may be different directions. The first direction (A) and the second direction (B) may be opposite to each other. The second gear 292 may include an annexed gear 292*a* and a pinion 292*b*. The number of serration shapes of the annexed gear 292*a* may be different from the number of serration shapes of the pinion 292*b*. The annexed gear 292*a* and the pinion 292*b* may rotate on the basis of the same rotation shaft (i.e., a second shaft 322). The annexed gear 292*a* may be located close to the frame 300, and the pinion 292*b* may be located distant from the frame 300. In other words, the annexed gear 292*a* may be located forward of the pinion 292*b* in the drive shaft direction (T). In other words, the annexed gear 292*a* may be located distant from the connection member 270, and the pinion 292*b* may be located close to the connection member 270. The pinion 292*b* may be rotatably coupled to the connection member 270. In more detail, the pinion 292*b* may be rotatably meshed with the rack 274 of the guide rail 273.

The gear unit 290 may further include at least one third gear 293. The at least one third gear 293 may be arranged to provide rotational force of the first gear 291 to the second gear 292. A least one third gear 293 may include a first annexed gear 293*a* and a second annexed gear 293*b*. The number of serration shapes of the first annexed gear 293*a* may be different from the number of serration shapes of the second annexed gear 293*b*. The first annexed gear 293*a* and the second annexed gear 293*b* may rotate on the basis of the same rotation shaft (i.e., a third shaft 323). The first annexed gear 293*a* may be located close to the frame 300, and the second annexed gear 293*b* may be located distant from the frame 300. In other words, the first annexed gear 293*a* may be located forward of the second annexed gear 293*b* in the drive shaft direction (T).

At least one link unit 260 may further include a frame 300. The drive unit 280 may be located forward of the frame 300 in the drive shaft direction (T). The gear unit 290 may be located backward of the frame 300 in the drive shaft direction (T). In addition, the connection member 270 may be located backward of the frame 300 in the drive shaft direction (T).

The drive shaft 282 of the drive unit 280 may be coupled to the shaft coupling hole 310 formed in the frame 300. In more detail, the drive shaft 282 of the drive unit 280 may pass through the shaft coupling hole 310, and may face the rear side of the audio device 1*b*. The first gear 291 may be rotatably coupled to the drive shaft 282 of the drive unit 280 passing through the shaft coupling hole 310.

The shafts (321, 322, 323) of the gear unit 290 may be formed in the frame 300. The shafts (321, 322, 323) may be formed at a back surface of the frame 300 such that the shafts (321, 322, 323) can be extended in the backward direction. The shafts (321, 322, 323) may be integrated with the frame 300. The shafts (321, 322, 323) may include a first shaft 321 rotatably coupled to the front gear 294; a second shaft 322 rotatably coupled to the second gear 292; and a third shaft 323 rotatably coupled to the rear gear 295.

The operation procedures of the gear unit 290 are as follows. For convenience of description and better understanding of the present invention, it is assumed that at least one third gear 293 may include a front gear 294 located close to the frame 300; and a rear gear 295 located distant from the frame 300.

Through operation of the motor 281, the first gear 291 may rotate around the drive shaft 282. The rotational force of the first gear 291 may be transmitted to the front gear 294 of the third gear 293. In more detail, the rotational force of the first gear 291 may be transferred to the first annexed gear 293*a* of the front gear 294 rotatably meshed with the first gear 291. The first annexed gear 293*a* of the front gear 294 rotates around the third shaft 323, such that the second annexed gear 293*b* of the front gear 294 may rotate in the same direction as the first annexed gear 293*a* of the front gear 294. The rotational force of the second annexed gear 293*b* of the front gear 294 may be transferred to the rear gear 295. In more detail, the rotational force of the second annexed gear 293*b* of the front gear 294 may be transferred to the first annexed gear 293*a* of the rear gear 295 rotatably meshed with the second annexed gear 293*b* of the front gear 294. Since the first annexed gear 293*a* of the rear gear 295 rotates around the third shaft 323, the second annexed gear 293*b* of the rear gear 295 may rotate in the same direction as the first annexed gear 293*a* of the rear gear 295. The rotational force of the second annexed gear 293*b* of the rear gear 295 may be transferred to the second gear 292. In more detail, the rotational force of the second annexed gear 293*b* of the rear gear 295 may be transferred to the annexed gear 292*a* of the second gear 292 rotatably meshed with the second annexed gear 293*b* of the rear gear 295. Since the annexed gear 292*a* of the second gear 292 rotates around the second shaft 322, the pinion 292*b* of the second gear 292 may rotate in the same direction as the annexed gear 292*a* of the second gear 292. The rotational force of the second gear 292 may be transferred to the connection member 270. In more detail, since the pinion 292*b* of the second gear 292 is rotatably meshed with the rack 274 of the guide rail 273, the connection member 270 may perform translational motion in a plurality of rotation shaft directions (X).

If the connection member 270 moves in the first direction (A) along the plurality of rotation shaft directions (X), the first gear 291 may rotate clockwise, and the front gear 294 may rotate counterclockwise. In addition, the rear gear 295 may rotate clockwise, and the second gear 292 may rotate counterclockwise.

In contrast, if the connection member 270 moves in the second direction (B) along the plurality of rotation shaft directions (X), the first gear 291 may rotate counterclockwise, and the front gear 294 may rotate clockwise. In addition, the rear gear 295 may rotate counterclockwise, and the second gear 292 may rotate clockwise.

The audio device 1*b* may further include a cover 330 fixed to any one of the plurality of contiguous units 200 arranged to face the connection member 270.

FIG. 16 is a rear view illustrating that the audio device is bent in one direction according to a third embodiment of the present invention. FIG. 17 is a plan view illustrating the shape of the audio device shown in FIG. 16. For convenience of description and better understanding of the present invention, other reference numbers (not shown) will refer to constituent elements shown in FIGS. 12 to 15. The amplifier unit 210 and at least one speaker unit 220 connected to the amplifier unit 210 are shown in FIGS. 16 and 17.

Referring to FIGS. 16 and 17, the audio device 1*b* may be bent or curved in the forward direction. That is, the plurality of contiguous units 200 rotates on the basis of a plurality of rotation shafts 250, such that the contiguous units 200 may be bent or curved in the forward direction. In more detail, at least one speaker unit 220 coupled to the amplifier unit 210 may rotate on the basis of the plurality of rotation shafts 250, so that the speaker unit 220 may be bent in the forward direction of the audio device 1*b*.

If the connection member 270 moves in the first direction (A), the amplifier unit 210 is fixed, and at least one speaker unit 220 may rotate on the basis of the plurality of rotation shafts 250 in any one of the drive shaft directions (T). That is, if the connection member 270 moves in the first direction (A), at least one speaker unit 220 may be bent in the forward direction on the basis of the plurality of rotation shafts 250.

In addition, if the connection member 270 moves in the first direction (A), the first speaker unit 221 and the second speaker unit 222 coupled to each other may rotate about the plurality of rotation shafts 250 in any one of the drive shaft directions (T). That is, if the connection member 270 moves in the first direction (A), the first speaker unit 221 and the second speaker unit 222 coupled to each other may be bent in the forward direction on the basis of the plurality of rotation shafts 250.

If the connection member 270 moves in the first direction (A), the protrusion unit 201 moving along the switching guide 272 may be disposed at the second groove unit 272*e* of the second slide unit 272*b*.

In another aspect of the present invention, the plurality of units 200 may be connected to a plurality of rotation shafts 250 and the connection member 270 such that the plural units 200 are spaced apart from each other and rotate about the plural rotation shafts 250. If the connection member 270 may move in the first direction (A), the plural units 200 may rotate in the forward direction on the basis of the plurality of rotation shafts 250, and the spacing distance between the plural units 200 may be gradually increased as the positions of the units 200 approach the rear end.

FIG. 18 is a rear view illustrating that the audio device is bent in the other direction according to a third embodiment of the present invention. FIG. 19 is a plan view illustrating the shape of the audio device shown in FIG. 18. For convenience of description and better understanding of the present invention, other reference numbers (not shown) will refer to constituent elements shown in FIGS. 12 to 15. The amplifier unit 210 and at least one speaker unit 220 connected to the amplifier unit 210 are shown in FIGS. 18 and 19.

Referring to FIGS. 18 and 19, the audio device 1*b* may be bent or curved in the backward direction. That is, the plurality of contiguous units 200 rotates on the basis of a plurality of rotation shafts 250, such that the contiguous units 200 may be bent or curved in the backward direction. In more detail, at least one speaker unit 220 coupled to the amplifier unit 210 may rotate on the basis of the plurality of rotation shafts 250, so that the speaker unit 220 may be bent in a backward direction of the audio device 1*b*.

If the connection member 270 moves in the second direction (B), the amplifier unit 210 is fixed, and at least one speaker unit 220 may rotate on the basis of the plurality of rotation shafts 250 in any one of the drive shaft directions CT). That is, if the connection member 270 moves in the second direction (B), at least one speaker unit 220 may be bent in the backward direction on the basis of the plurality of rotation shafts 250.

In addition, if the connection member 270 moves in the second direction (B), the first speaker unit 221 and the second speaker unit 222 coupled to each other may rotate about the plurality of rotation shafts 250 in the other one of the drive shaft directions (T). That is, if the connection member 270 moves in the second direction (B), the first speaker unit 221 and the second speaker unit 222 coupled to each other may be bent in the backward direction on the basis of the plurality of rotation shafts 250.

If the connection member 270 moves in the second direction (B), the protrusion unit 201 moving along the switching guide 272 may be disposed at the first groove unit 272*d* of the first slide unit 272*a*.

In another aspect of the present invention, the plurality of units 200 may be connected to a plurality of rotation shafts 250 and the connection member 270 such that the plural units 200 are spaced apart from each other and rotate about the plural rotation shafts 250. If the connection member 270 may move in the second direction (B), the plural units 200 may rotate in a backward direction on the basis of the plurality of rotation shafts 250, and the spacing distance between the plural units 200 may be gradually reduced as the positions of units 200 approach the rear end.

FIGS. 20A to 20D are plan views illustrating various shapes of the audio device according to a third embodiment of the present invention. For convenience of description and better understanding of the present invention, other reference numbers (not shown) will refer to constituent elements shown in FIGS. 12 to 15.

Referring to FIGS. 20A to 20D, the audio device 1*b* may be configured in various shapes.

Referring to FIG. 20A, the audio device 1*b* may be elongated in the longitudinal direction (L) of the audio device 1*b*. In other words, the audio device 1*b* may be formed in a straight line shape. In this case, the protrusion unit 201 moving along the switching guide 272 may be disposed at the connection unit 272*c*.

Referring to FIG. 20B, the audio device may be bent or curved in the forward direction of the audio device 1*b*. The audio device 1*b* may be bent to have a convex shape in the backward direction. In other words, the plurality of units 200 may rotate about the plurality of rotation shafts 250, so that the plural units 200 may have a convex shape in the backward direction of the audio device 1*b*. The amplifier unit 210 may be fixed, and at least one speaker unit 220 may rotate about the plurality of rotation shafts 250 such that the speaker unit 220 may be bent in the forward direction of the audio device 1*b*.

Referring to FIG. 20C, the audio device 1*b* may be bent in the backward direction of the audio device 1*b*. The audio device 1*b* may have a convex shape in the forward direction of the audio device 1*b*. In other words, the plurality of units 200 may rotate about the plurality of rotation shafts 250 such that the plural units 200 may have a convex shape in the forward direction of the audio device 1*b*. The amplifier unit 210 may be fixed, and at least one speaker unit 220 may rotate around the plurality of rotation shafts 2150 so that the speaker unit 220 may be bent in the backward direction of the audio device 1*b*.

Referring to FIG. 20D, the audio device 1*b* may be bent in the forward or backward direction of the audio device 1*b*. The audio device 1*b* may have a convex shape in the forward or backward direction of the audio device 1*b*. The audio device 1*b* may be formed in a zigzag pattern. In other words, the plurality of units 200 may rotate about the plurality of rotation shafts 250, so that the plurality of units 200 may have a convex shape in the forward or backward direction of the audio device 1*b*. The amplifier unit 210 may be fixed, and at least one speaker unit 220 may rotate about the plurality of rotation shafts 250 so that the speaker unit 220 may be bent in the forward or backward direction of the audio device 1*b*. The respective units 200 may independently rotate about the plurality of rotation shafts 250 without causing interference therebetween.

FIG. 21 is a perspective view illustrating an arrangement structure of the audio device shown in the third embodiment and a peripheral device. For convenience of description and better understanding of the present invention, other reference numbers (not shown) will refer to constituent elements shown in FIGS. 12 to 15.

Referring to FIG. 21, the audio device 1*b* may be arranged to suit a peripheral device 400. Although the peripheral device 400 may include a television, the scope or spirit of the peripheral device 400 is not limited thereto. For convenience of description and better understanding of the present invention, the following embodiment will focus on a television. If a display unit 410 of the television is flat or even, the audio device 1*b* may be formed in a straight line shape. Alternatively, if the display unit 410 of the television has a curved surface or a curve, the audio device 1*b* may be formed in a curved shape.

The audio devices (1, 1*a*, 1*b*) may be curved or rotated by a user. That is, the user may directly curve or rotate the audio devices (1, 1*a*, 1*b*) as desired.

Alternatively, the audio devices (1, 1*a*, 1*b*) may be automatically curved or rotated through a separate power source. If the audio devices (1, 1*a*, 1*b*) are automatically curved or rotated through separate power sources, a stand or rest (not shown) may be requested to reduce friction with a ground on which the audio devices (1, 1*a*, 1*b*) are disposed. That is, the audio devices (1, 1*a*, 1*b*) may be disposed at the stand or rest such that the audio devices (1, 1*a*, 1*b*) can be spaced apart from the ground.

FIG. 22 is a control block diagram illustrating the audio device shown in the third embodiment and a peripheral device. For convenience of description and better understanding of the present invention, other reference numbers (not shown) will refer to constituent elements shown in FIGS. 12 to 15. In addition, as can be seen from FIG. 21, the following embodiment will focused on the television as one example of the peripheral device 400.

Referring to FIG. 22, a peripheral device 400 may include a receiver 420, a display unit 410, an input unit 430, and a controller 440.

The controller 440 may be implemented as an integrated circuit (IC) in a micro-processor, or may also be implemented by software such as firmware. The controller 440 may also be implemented as a separate chip. The controller 440 shown in FIG. 22 includes a display controller 460, a drive controller 470, and a signal processor 450.

The receiver 420 may receive a broadcast signal. The broadcast signal received by the receiver 420 may be based on a broadcast image displayed on the display unit 410.

In order to display a broadcast image, the receiver 420 may include a tuner for channel tuning; and a demodulator for demodulating a broadcast signal received through the tuned channel.

The tuner may select a radio frequency (RF) broadcast signal corresponding to a predetermined channel from among the RF broadcast signals received through an antenna. In addition, the tuner may convert the selected RF broadcast signal into an intermediate frequency (IF) signal, a baseband image, or a sound signal.

The demodulator may receive the signal converted by the tuner and then demodulate the received signal. As a result, the demodulator may output a stream signal. In this case, the stream signal may be a multiplexed signal of an image signal, a sound signal, and a data signal.

The peripheral device 400 may further include a first interface 480 configured to receive an external image signal, an external sound signal, or an external information signal. In this case, the external image signal, the external sound signal, and the external information signal may be basic signals of the remaining images other than the broadcast image.

For this purpose, the first interface 480 may further include a network interface and an external device interface. The first interface 480 may receive an external signal from the external part through the network interface or the external device interface, and may transmit the received signal to the controller 440. In accordance with one embodiment, the first interface 480 of the peripheral device 400 may communicate with the second interface 600 of the audio device 1*b*.

The network interface may connect the peripheral device 400 to wired/wireless networks having the Internet. The network interface may include an Ethernet terminal for connecting to the wired network. For connection to the wireless network, the network interface may use Wireless LAN (WLAN), Wi-Fi, WiBro (Wireless Broadband), WiMAX (World Interoperability for Microwave Access), HSDPA (High Speed Downlink Packet Access), etc.

The external interface may connect the external device to the peripheral device 400. The external device interface may communicate with the external device (for example, a Digital Versatile Disc (DVD), a Blu-ray player, a game console, a computer (laptop), an audio device 1*b*, etc.) by wire or wirelessly. The external device interface may receive an external signal from the external device, and may transmit the received external signal to the controller 440.

The controller 440 may include a signal processor 450 that may demultiplex a stream signal received from the receiver 420 or may process the demultiplexed signal. As a result, the controller 440 may generate an image signal capable of being displayed on the display unit 410 or may generate a sound signal capable of being output by a sound output unit (not shown). The sound signal generated by the controller 440 may be output through at least one of a sound output unit (not shown) mounted to the peripheral device 400 and another sound output unit 900 of the audio device 1*b*.

Finally, the display unit 410 may receive an image signal processed by the controller 440, and then output a broadcast image. The sound output unit (not shown) may receive the sound signal processed by the controller 440, and may output the received sound signal. In addition, the sound output unit 900 of the audio device 1*b* may receive the sound signal processed by the controller 700 of the audio device 1*b* on the basis of the signal transferred from the first interface 4880 to the second interface 600.

In this case, the display unit 410 may receive a power-supply signal under the control of the display controller 460 as one component of the controller 440, and may output a broadcast image.

In addition, the controller 440 may control overall operation of the peripheral device 440. For example, the controller 440 may control the power on/off function of the peripheral device 400, and may control the output of image/sound signals. In addition, as described above, the controller 440 may control the drive unit 490 such that curvature modification of the display unit 410 can be performed (i.e., the display unit 410 can be curved).

For this purpose, the controller 440 may generate a control signal according to the internal operation, and may transmit the generated control signal to individual components of the peripheral device 400. On the other hand, the controller 430 may generate a control signal according to a user control command entered via the input unit 430, and may control the operation of the peripheral device 400 using the generated control signal.

The input unit 430 may receive a control command related to the operation of the peripheral device 400 from the user. For example, the input unit 430 may receive a command indicating a change of the displayed image type, a command indicating a volume change of the output sound, a command indicating a channel change of the displayed image, a command indicating a brightness of the displayed image, etc.

In addition, the input unit 430 may receive a control command related to the operation of the audio device 1*b* from the user.

The input unit 430 may receive a command for supplying a power-supply signal to the peripheral device 400. If the power-supply signal is supplied to the peripheral device 400 upon receiving a user input signal, the controller 440 may perform booting for normal operation of the peripheral device 400.

During the boot process, the controller 440 may control the drive unit 490 such that curvature modification of the peripheral device 400 can be performed. In more detail, the controller 440 may further include a drive controller 470 for controlling a power-supply signal supplied to the drive unit 490.

The audio device 1*b* may include an input unit 500, a second interface 600, a controller 700, and a drive unit 800.

The controller 700 may be implemented as an integrated circuit (IC) in a micro-processor, or may also be implemented by software such as firmware. Alternatively, the controller 440 may be implemented as a separate chip.

The second interface 600 may receive a signal from the peripheral device 400. That is, the second interface 600 may receive a signal from the first interface 480 of the peripheral device 400. The audio device 1*b* may be curved or bent such that the audio device 1*b* can be arranged to suit the display unit 410 of the peripheral device 400. That is, if the display unit 410 of the peripheral device 400 has a curved surface or a curve, the audio device 1*b* may have a curved shape such that the audio device 1*b* can be arranged to suit the display unit 410 of the peripheral device 400. In more detail, the speaker unit 220 may be bent in the forward or backward direction of the audio device 1*b* on the basis of the amplifier unit 210.

The second interface 600 may further include a network interface or an external device interface. The second interface 600 may receive an external signal from the external part through the network interface or the external device interface, and may transmit the received signal to the controller 700.

The network interface may connect the audio device 1*b* to wired/wireless networks having the Internet. The network interface may include an Ethernet terminal for connection to the wired network. For connection to the wireless network, the network interface may use Wireless LAN (WLAN), Wi-Fi, WiBro (Wireless Broadband), WiMAX (World Interoperability for Microwave Access), HSDPA (High Speed Downlink Packet Access), etc.

The external device interface may connect the external device to the audio device 1*b*. The external device interface may communicate with the external device (for example, a Digital Versatile Disc (DVD), a Blu-ray player, a game console, a computer (laptop), a television, etc.) by wire or wirelessly. The external device interface may receive an external signal from the external device, and may transmit the received external signal to the controller 700.

The controller 700 may control the overall operation of the audio device 1*b*. For example, the controller 700 may control the power on/off function of the audio device 1*b*, and may control the output of image/sound signals. In addition, as described above, the controller 700 may control the drive unit 800 such that the bending degree or the rotation degree of the audio device 1*b* can be changed. That is, the controller 700 may be installed into the amplifier unit 210 such that the bending degree or the bending direction of the speaker unit 220 can be adjusted with respect to the amplifier unit 210.

For this purpose, the controller 700 may generate a control signal according to the internal operation, and may transmit the generated control signal to individual components of the audio device 1*b*. On the other hand, the controller 700 may generate a control signal according to a user control command entered via the input unit 500, and may control the operation of the audio device 1*b* using the generated control signal.

The input unit 500 may receive a control command related to operation of the audio device 1*b* from the user. For example, the input unit 500 may receive a command indicating volume change of the output sound, or the like.

Alternatively, the input unit 500 may receive a command for supplying a power-supply signal to the audio device 1*b*.

Alternatively, the input unit 500 may receive a control command indicating the bending degree or the rotation degree of the audio device 1*b*.

The controller 700 may control the drive unit 800 such that the audio device 1*b* can be curved or bent. The drive unit 800 may have the same meaning as the drive unit 280. The drive unit 800 may adjust the bending degree or the bending direction of the speaker unit 220 with respect to the amplifier unit 210. That is, through the operation of the drive unit 800, the speaker unit 220 may be curved or rotated in the forward or backward direction of the audio device 1*b* with respect to the amplifier unit 210.

The audio device 1*b* may further include a sound output unit 900. The controller 700 may include a signal processor (not shown) that may demultiplex a stream signal received from the second interface 600 or may process the demultiplexed signal. As a result, the controller 700 may generate a sound signal capable of being output by the sound output unit 900. The sound signal generated from the controller 700 may be output through the sound output unit 900 of the audio device 1*b*.

The audio device 1*b* may be interoperable with the peripheral device 400, or may be used separately from the peripheral device 400.

FIG. 23 is a flowchart illustrating a method for controlling the audio device shown in the third embodiment of the present invention. For convenience of description and better understanding of the present invention, other reference numbers (not shown) will refer to constituent elements shown in FIGS. 12 to 15 and FIGS. 21 and 22. In addition, as shown in FIG. 21, the following embodiment will focus on the television as one example of the peripheral device 400.

A method for controlling the audio device 1*b* will hereinafter be described with reference to FIG. 23.

Referring to FIG. 23, a state of the peripheral device 400 is checked in operation S1. In more detail, it is determined whether the display unit 410 of the peripheral device 400 forms a curved surface or a curve. If the display unit 410 of the peripheral device 400 forms a curved surface or a curve when the state of the peripheral device 400 is checked, the audio device 1*b* may be curved or rotated such that the audio device 1*b* can be arranged to suit the display unit 410 in operation S2. That is, the shape of the audio device 1*b* can be modified such that the audio device 1*b* can be arranged to suit the display unit 410 of the peripheral device 400.

The shape of the audio device 1*b* may be modified separately from the peripheral device 400. That is, the shape of the audio device 1*b* may be modified by a command that is input to the input unit 500 by the user.

It is determined whether or not a user input signal received from the input unit 500 is present in operation S3. If the user input signal is confirmed, the bending degree or the rotation degree of the audio device 1*b* may be changed according to the user input signal in operation S4. That is, if the user input signal is confirmed, the audio device 1*b* may be curved or bent according to the user input signal in operation S4.

If the user input signal is not confirmed, the audio device 1*b* may maintain a conventional state in operation S5. That is, if the user input signal is not confirmed, the audio device 1*b* may remain flat. In other words, the audio device 1*b* may be extended in a long shape (i.e., in a straight line shape) in the longitudinal direction (L) of the audio device 1*b*.

As a result, the audio device 1*b* may be curved or bent to be matched with a predetermined value, or may be curved or bent to be matched with a predetermined value entered by the user.

FIG. 24 illustrates curvature modification setting windows for both a display unit of a peripheral device and an audio device such that the curvature modification setting windows are displayed on the display unit of the peripheral device and the bending degree of the audio device of the third embodiment can be adjusted in association with the peripheral device. For convenience of description and better understanding of the present invention, other reference numbers (not shown) will refer to constituent elements shown in FIGS. 12 to 15 and FIGS. 21 to 23. In addition, as shown in FIG. 21, the following embodiment will focus on the television as one example of the peripheral device 400.

Referring to FIG. 24, the display unit 410 of the peripheral device 400 may display the curvature modification setting window 1000 of the display unit 410 such that the user can establish curvature modification of the display unit 410. In addition, if the bending degree (i.e., curvature) of the audio device 1*b* is adjusted in response to the peripheral device 400, the display unit 410 of the peripheral device 400 may display the curvature modification setting window 1000 such that the user can establish the display unit 410 and the curvature modification of the audio device 1*b*.

The curvature modification setting window 1000 may include an item for indicating the presence or absence of curvature modification (P1) of the display unit 410 and an item for indicating the presence or absence of curvature modification (P2) of the audio device 1*b*. However, since FIG. 24 shows one embodiment of the curvature modification setting window 1000 of the display unit 410 of the peripheral device 400, items capable of being displayed on the curvature modification setting window 1000 are not limited to the items shown in FIG. 24.

FIGS. 25A and 25B are conceptual diagrams illustrating a method for establishing the presence or absence of curvature modification of the audio device shown in the third embodiment of the present invention. For convenience of description and better understanding of the present invention, other reference numbers (not shown) will refer to constituent elements shown in FIGS. 12 to 15 and FIGS. 21 to 24. In addition, as shown in FIG. 21, the following embodiment will focus on the television as one example of the peripheral device 400.

Referring to FIGS. 25A and 25B, if the curvature modification setting window 1000 is displayed on the display unit 410, the input unit 430 may receive a selection command of the item (P2) for setting the presence or absence of curvature modification from the user. FIG. 25A shows an exemplary method for allowing the user to select the item for setting the presence or absence of curvature modification according to the embodiment of the present invention.

In response to the user input signal, the display unit 410 of the peripheral device 400 may display a window 1100 for setting whether curvature modification is performed. As shown in FIG. 25B, if the window 1100 for setting the presence or absence of curvature modification is displayed, the input unit 430 may receive a command for setting whether curvature modification of the audio device 1*b* will be performed.

As described above, if the presence or absence of curvature modification of the audio device 1*b* is determined according to the user input signal, the audio device 1*b* being selectively curved may be supplied only upon receiving a request signal from the user.

The curvature modification setting window 1000 of the audio device 1*b* may be displayed on the display unit (not shown) of the audio device 1*b*.

A method for setting whether curvature modification of the display unit 410 of the peripheral device 400 is performed is identical to the method for setting whether curvature modification of the audio device 1*b* is performed, and as such a detailed description thereof will herein be omitted for convenience of description.

Although a few embodiments of the present invention have been shown and described, it would be appreciated by those skilled in the art that changes may be made in these embodiments without departing from the principles and spirit of the invention, the scope of which is defined in the claims and their equivalents.

The invention claimed is:

1. An audio device comprising:

an amplifier unit configured to amplify an audio signal;

at least one speaker unit configured to output the amplified audio signal as a sound signal; and at least one link unit rotatably connecting the at least one speaker unit to the amplifier unit, wherein the at least one link unit includes a drive unit configured to provide a driving force by which the at least one speaker unit rotates with respect to the amplifier unit about an axis that is perpendicular to a sound traveling direction of the at least one speaker unit.

2. The audio device according to claim 1, wherein the at least one speaker unit is arranged to rotate on the basis of a separate rotation shaft.

3. The audio device according to claim 1, wherein the at least one link unit includes a connection member through which the amplifier unit is connected to at least one speaker unit adjacent to the amplifier unit among the at least one speaker unit so as to control a rotation operation of the at least one adjacent speaker unit.

4. The audio device according to claim 3, wherein:

the at least one speaker unit is arranged to rotate on the basis of a separate rotation shaft; and the connection member is arranged to be movable along a direction of the separate rotation shaft.

5. The audio device according to claim 4, wherein the at least one link unit includes a gear unit disposed between the drive unit and the connection member in such a manner that the gear unit rotates.

6. The audio device according to claim 5, wherein the gear unit includes:

a first gear coupled to a drive shaft of the drive unit; and a second gear coupled to the connection member.

7. The audio device according to claim 6, wherein the connection member includes:

a guide rail extended along the direction of the separate rotation shaft in such a manner that the second gear is rotatably coupled to the guide rail.

8. The audio device according to claim 7, wherein:

the at least one speaker unit includes a rib formed to protrude along a drive shaft direction; and the connection member further includes a switching guide coupled to the rib.

9. The audio device according to claim 8, wherein the switching guide is gradually tilted toward the guide rail as it gradually moves in a first direction along the rotation shaft direction.

10. The audio device according to claim 9, wherein:

the connection member moves either in the first direction or in a second direction different from the first direction along the rotation shaft direction in response to rotation of the second gear; and if the connection member moves in the first direction, the at least one speaker unit rotates in one direction along the drive shaft direction on the basis of the separate rotation shaft.

11. The audio device according to claim 10, wherein:

if the connection member moves in the second direction, the at least one speaker unit rotates in another direction along the drive shaft direction on the basis of the separate rotation shaft.

12. The audio device according to claim 6, wherein the gear unit further includes:

at least one third gear arranged to transmit rotational force of the first gear to the second gear.

13. The audio device according to claim 7, wherein:

the at least one speaker unit includes a first speaker unit and a second speaker unit that include a plurality of ribs formed to protrude along a drive shaft direction in such a manner that the first speaker unit and the second speaker unit are spaced apart from each other; and the connection member includes a support guide coupled to any one of the plurality of ribs contained in the first speaker unit, and a switching guide coupled to any one of the plurality of ribs contained in the second speaker unit.

14. The audio device according to claim 13, wherein:

the switching guide is gradually tilted toward the guide rail as it gradually moves in a first direction along the rotation shaft direction; and if the connection member moves in the first direction, the first speaker unit and the second speaker unit are configured to rotate in one direction along the drive shaft direction on the basis of the separate rotation shaft.

15. The audio device according to claim 14, wherein:

if the connection member moves in a second direction different from the first direction along the rotation shaft direction, the first speaker unit and the second speaker unit are configured to rotate in another direction along the drive shaft direction on the basis of the separate rotation shaft.

16. The audio device according to claim 7, wherein:

the amplifier unit includes a projection formed to protrude along a drive shaft direction; and the connection member further includes a support guide coupled to the projection.

17. An audio device for outputting an audio signal as a sound signal, comprising:

a plurality of rotation shafts arranged in a forward direction; and a plurality of units coupled to be curved on the basis of the plurality of rotation shafts, the plurality of units comprising at least one fixed unit and at least one speaker unit;

a drive unit configured to provide a driving force by which the plurality of units rotate to be curved on the basis of the plurality of rotation shafts; and a link unit provided between a first unit from among the plurality of units and a second unit from among the plurality of units, the link unit being directly coupled to the drive unit, the first unit, and the second unit.

18. The audio device according to claim 17, wherein the plurality of rotation shafts is integrated with the plurality of units.

19. The audio device according to claim 17, wherein the link unit includes:

a connection member arranged to be movable along a direction of the plurality of rotation shafts so as to control a rotation operation of the first unit and the second unit.

20. The audio device according to claim 17, wherein the first unit includes a first protrusion coupled to a first guide of the link unit, wherein the second unit includes a second protrusion coupled to a second guide of the link unit, and wherein the drive unit includes a pinion coupled to a guide rail of the link unit.

* * * * *